US009126783B2

(12) United States Patent
Oikawa et al.

(10) Patent No.: US 9,126,783 B2
(45) Date of Patent: Sep. 8, 2015

(54) IMAGE FORMING APPARATUS

(71) Applicants: Naoki Oikawa, Kanagawa (JP); Yukihiko Natsui, Kanagawa (JP); Munehisa Fuda, Kanagawa (JP); Ryuhei Waragai, Kanagawa (JP); Masanobu Yoshida, Kanagawa (JP); Yusaku Matsumoto, Kanagawa (JP); Tsuyoshi Sawamoto, Kanagawa (JP); Masaru Ohba, Kanagawa (JP)

(72) Inventors: Naoki Oikawa, Kanagawa (JP); Yukihiko Natsui, Kanagawa (JP); Munehisa Fuda, Kanagawa (JP); Ryuhei Waragai, Kanagawa (JP); Masanobu Yoshida, Kanagawa (JP); Yusaku Matsumoto, Kanagawa (JP); Tsuyoshi Sawamoto, Kanagawa (JP); Masaru Ohba, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/267,971

(22) Filed: May 2, 2014

(65) Prior Publication Data

US 2014/0339761 A1 Nov. 20, 2014

(30) Foreign Application Priority Data

May 14, 2013 (JP) ..... 2013-102111

(51) Int. Cl.

| | |
|---|---|
| ***B65H 3/44*** | (2006.01) |
| ***B65H 1/08*** | (2006.01) |
| ***B65H 1/04*** | (2006.01) |
| ***B65H 7/20*** | (2006.01) |
| *B65H 7/04* | (2006.01) |
| *B65H 43/02* | (2006.01) |

(52) U.S. Cl.

CPC .. *B65H 1/08* (2013.01); *B65H 1/04* (2013.01); *B65H 7/20* (2013.01); *B65H 7/04* (2013.01); *B65H 43/02* (2013.01); *B65H 2405/324* (2013.01); *B65H 2553/83* (2013.01)

(58) Field of Classification Search

CPC ..... B65H 7/04; B65H 43/02; B65H 2553/83; B65H 2405/32; B65H 2405/321; B65H 2405/324

USPC ..... 271/9.01

See application file for complete search history.

(56) References Cited

U.S. PATENT DOCUMENTS

| | | | | |
|---|---|---|---|---|
| 5,016,864 | A * | 5/1991 | Nonami | 271/38 |
| 7,627,281 | B2 * | 12/2009 | Tanaka et al. | 399/377 |
| 8,191,892 | B2 | 6/2012 | Fuda | |
| 2013/0062827 | A1 | 3/2013 | Fuda | |
| 2013/0334764 | A1 | 12/2013 | Fuda | |

FOREIGN PATENT DOCUMENTS

| | | |
|---|---|---|
| JP | 2002-160850 | 6/2002 |
| JP | 4057232 | 12/2007 |

* cited by examiner

*Primary Examiner* — Howard Sanders

(74) *Attorney, Agent, or Firm* — Harness, Dickey & Pierce, P.L.C.

(57) ABSTRACT

An image forming apparatus includes a sheet bundle housing unit that houses recording sheets piled as a sheet bundle; a swing member having a sheet contact portion on one end side, and swinging between a projection position at which the sheet contact portion projects above a sheet placement surface of the housing unit and a non-projection position at which the sheet contact portion does not project above the sheet placement surface, the swing member moving from the projection position to the non-projection position by the sheet bundle; a sheet detection unit that detects the sheet bundle in the housing unit using the swing member; and an interlocking mechanism that moves the swing member to the non-projection position, regardless of presence or absence of the sheet bundle in the housing unit, by interlocking with the housing unit being pulled out from an apparatus body.

10 Claims, 16 Drawing Sheets

IMAGE FORMING APPARATUS

CROSS-REFERENCE TO RELATED APPLICATION

The present application claims priority to and incorporates by reference the entire contents of Japanese Patent Application No. 2013-102111 filed in Japan on May 14, 2013.

BACKGROUND OF THE INVENTION

1. Field of the Invention

The present invention relates to an image forming apparatus.

2. Description of the Related Art

Conventionally, the image forming apparatus described in Japanese Patent No. 4057232 is known as such a kind of image forming apparatus. FIG. 28 is a cross section partially illustrating a sheet feeding tray 950 serving as a sheet bundle housing unit of an image forming apparatus described in Japanese Patent No. 4057232. The sheet feeding tray 950 houses a plurality of recording sheets P piled as a sheet bundle. A bottom plate 951 on which the sheet bundle is placed is provided with a partial opening 952. There is provided, under the bottom plate 951, an end sensor 954 including a swing member 953 swingable with a fixed end as an axis. A free end of the swing member 953 is a hemispherical sheet contact portion 953*a* and projects above the bottom plate 951 through the opening 952. When the sheet bundle placed on the bottom plate 951 presses downward the sheet contact portion 953*a* projecting above the bottom plate 951, the swing member 953 moves, along a swing direction, to a position at which the sheet contact portion 953*a* does not project above the bottom plate 951. When the sheet bundle is removed from the bottom plate 951, the swing member 953 moves, along the swing direction, to a position at which the sheet contact portion 953*a* projects above the bottom plate 951. The end sensor 954 detects presence or absence of a sheet bundle on the sheet feeding tray 950 based on such movement of the swing member 953.

To refill the sheet feeding tray 950 having a such configuration with a sheet bundle normally, an operator lowers a sheet bundle held in his/her hand, brings it into contact with a sheet placement surface of the bottom plate 951, and then slides the sheet bundle on the placement surface for alignment before leaving the hand from the sheet bundle. When the sheet bundle is placed on a placement surface area where the sheet bundle is not in contact with the sheet contact portion 953*a*, prior to the alignment, it is possible that the sheet bundle be caught on the sheet contact portion 953*a* when being slid, which may force the operator to perform placement operation again. When the sheet bundle is placed on the sheet contact portion 953*a* and then slid so as to prevent the sheet bundle from being caught, it is possible that the sheet bundle be damaged by rubbing with the sheet contact portion 953*a*.

Therefore, there is need for an image forming apparatus that enables refilling of the sheet bundle housing unit with a sheet bundle without allowing the sheet bundle to be caught on the sheet contact portion or damaged by rubbing with the sheet contact portion.

SUMMARY OF THE INVENTION

It is an object of the present invention to at least partially solve the problems in the conventional technology.

According to an embodiment, there is provided an image forming apparatus that includes a sheet bundle housing unit that houses a plurality of recording sheets piled as a sheet bundle; a swing member having a sheet contact portion on one end side thereof relative to a swing axis, the swing member swinging, about the swing axis, between a projection position at which the sheet contact portion projects above a sheet placement surface of the sheet bundle housing unit and a non-projection position at which the sheet contact portion does not project above the sheet placement surface, the swing member moving from the projection position to the non-projection position by pressing of the sheet bundle placed on the sheet placement surface against the sheet contact portion; a sheet detection unit that detects presence or absence of the sheet bundle in the sheet bundle housing unit using the swing member; a visible image forming unit that forms a visible image on the recording sheet; and an interlocking mechanism that moves the swing member to the non-projection position, regardless of presence or absence of the sheet bundle in the sheet bundle housing unit, by interlocking with the sheet bundle housing unit being pulled out from an apparatus body.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 21 is a perspective view illustrating the sheet supply device in the state where the stock bundle housing unit in which no sheet bundle is set starts to be pressed in;

DETAILED DESCRIPTION OF THE PREFERRED EMBODIMENTS

The following will describe an embodiment in which the invention is applied to an electrophotographic copying machine (hereinafter, referred to simply as a copying machine).

Figure 1:
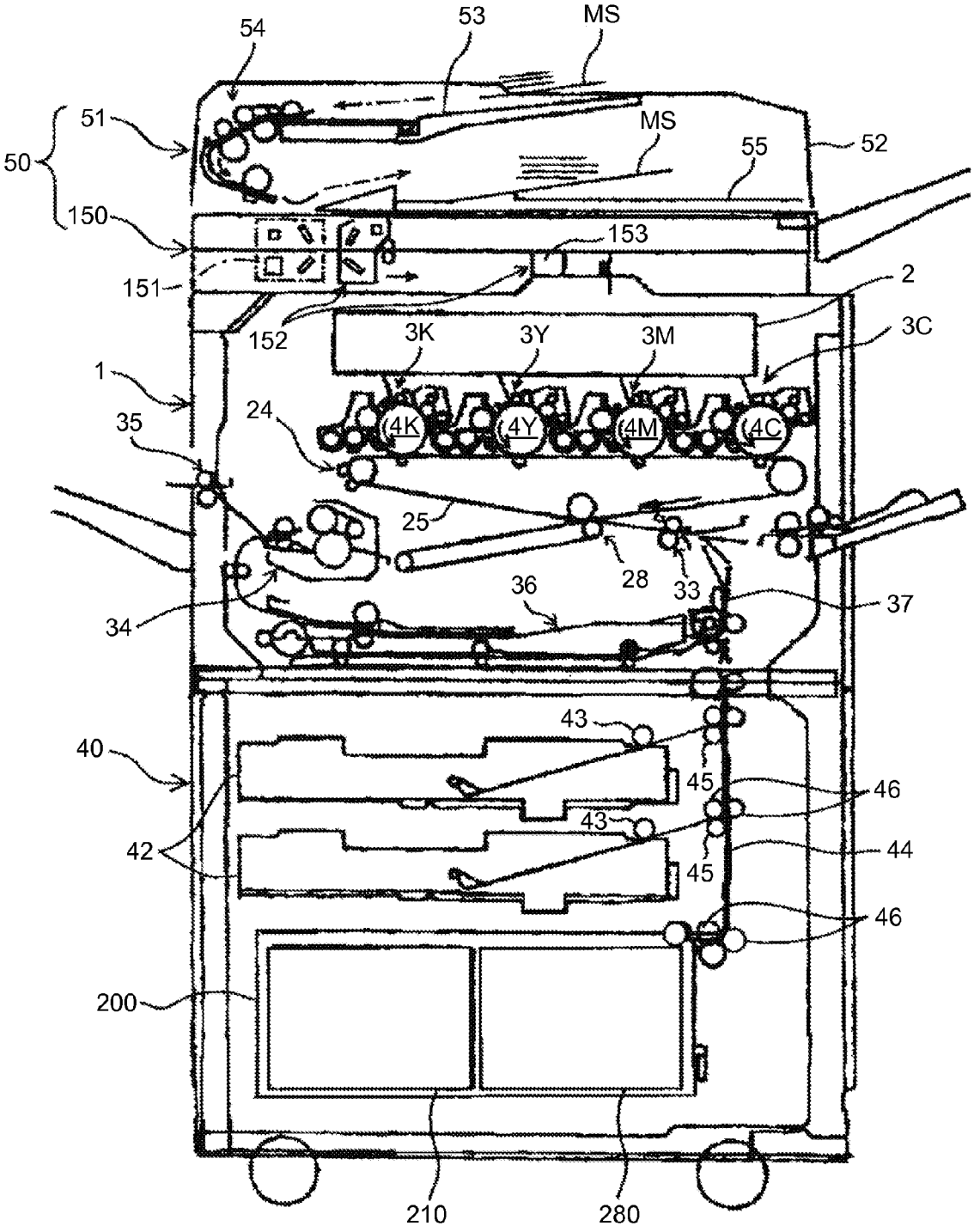
FIG. 1 is a schematic configuration diagram illustrating a copying machine according to an embodiment.

First, the basic configuration of the copying machine of the embodiment will be described. FIG. 1 is a schematic configuration diagram illustrating the copying machine according to the embodiment. The copying machine includes an image forming unit 1 as an image forming device, a sheet supply device 40, and an image reading unit 50. The image reading unit 50 as an image reading device includes a scanner 150 fixed on the image forming unit 1 and an automatic document feeder (hereinafter, referred to as an ADF) 51 as a sheet feeding device supported by the scanner 150.

The sheet supply device 40 includes two sheet feeding cassettes 42, feed rollers 43, a sheet feeding path 44, separation rollers 45, a pair of carriage rollers 46, a large-capacity sheet feeding unit 200, and other components.

Each of the sheet feeding cassettes 42 and the large-capacity sheet feeding unit 200 houses a plurality of recording sheets piled as a sheet bundle. Then, the feed roller 43 is pressed against a recording sheet on the top of the sheet bundle. When the feed roller 43 disposed in the vicinity of the sheet feeding cassettes 42 or the large-capacity sheet feeding unit 200 is rotated, the recording sheet on the top of the sheet bundle is fed to the sheet feeding path 44 from the sheet feeding cassettes 42 or the large-capacity sheet feeding unit 200.

In the vicinity of two sheet feeding cassettes 42 or the large-capacity sheet feeding unit 200, a first carriage roller of the pair of carriage rollers 46 and a second carriage roller disposed beside the first carriage roller (right side in FIG. 1) are in contact with each other and form a feed nip. Moreover, the separation roller 45 is disposed under the first carriage roller, and contacts with the first carriage roller from the lower side to form a separation carriage nip.

The recording sheet fed out from the sheet feeding cassettes 42 or the large-capacity sheet feeding unit 200 by rotation drive of the feed roller 43 enters the separation carriage nip formed by contact of the first carriage roller of the pair of carriage rollers 46 and the separation roller 45 disposed under the first carriage roller. In the separation carriage nip, the first carriage roller adjacent to the upper surface of the recording sheet provides, while being driven rotationally in the counterclockwise direction in FIG. 1, the recording sheet with conveying force from the side of the sheet feeding cassette 42 toward the sheet feeding path 44. By contrast, the separation roller 45 adjacent to the lower surface of the recording sheet provides, while being driven rotationally in the counterclockwise direction in FIG. 1, the recording sheet with conveying force from the side of the sheet feeding path 44 toward the sheet feeding cassette 42, thus intending to return the recording sheet to the sheet feeding cassette 42.

When only one piece of recording sheets is fed out from the sheet feeding cassettes 42 or the large-capacity sheet feeding unit 200, the first carriage roller and the separation roller 45 provide, in the separation carriage nip, the recording sheet with conveying force directing toward a direction opposite to each other. Then, when a load exceeding a given threshold is applied on a drive transmission system of the separation roller 45, a torque limiter disposed in the drive transmission system is operated to cut off transmission of driving force from a direct current (DC) brushless motor (not illustrated) to the separation roller 45. Consequently, the separation roller 45 is rotated together with the recording sheet conveyed by the first carriage roller, so that the recording sheet is fed out from the separation carriage nip toward the sheet feeding path 44.

When a plurality of piled recording sheets are fed out from the sheet feeding cassettes 42 or the large-capacity sheet feeding unit 200, the first carriage roller provides, in the separation carriage nip, the recording sheet on the top with conveying force from the side of the sheet feeding cassettes 42 toward the sheet feeding path 44. In this manner, the recording sheet on the top is fed out from the separation carriage nip toward the sheet feeding path 44. By contrast, the separation roller provides the recording sheets positioned on the bottom side with conveying force from the side of the sheet feeding path 44 toward the sheet feeding cassette, and returns the recording sheet on the bottom side back to the sheet feeding cassettes 42 from the separation carriage nip. In this manner, in the separation carriage nip, the recording sheet on the top is separated from other recording sheets and solely fed out to the sheet feeding path 44.

The recording sheet having entered to the sheet feeding path 44 enters the feed nip of the pair of carriage rollers 46, and is provided with conveying force from the lower side to the upper side in the vertical direction. In this manner, the recording sheet is conveyed toward a sheet feeding path 37 of the image forming unit 1 in the sheet feeding path 44 of the sheet supply device 40.

The image forming unit 1 as a visible image forming unit includes an optical writing device 2. The image forming unit 1 also includes four imaging units 3K, 3Y, 3M, 3C that form a toner image of black, yellow, magenta, and cyan (K, Y, M, C), respectively, a transfer unit 24, a sheet carriage unit 28, a pair of registration rollers 33, a fixing device 34, a switchback device 36, the sheet feeding path 37, and other components. Then, the image forming unit 1 drives light sources (not illustrated) disposed in the optical writing device 2, such as a laser diode or a light-emitting diode (LED), to irradiate drum-shaped four photosensitive elements 4K, 4Y, 4M, 4C with laser beams L. The irradiation forms electrostatic latent images on the surfaces of the photosensitive elements 4K, 4Y, 4M, 4C, and the latent images are developed to toner images through a given developing process.

Figure 2:
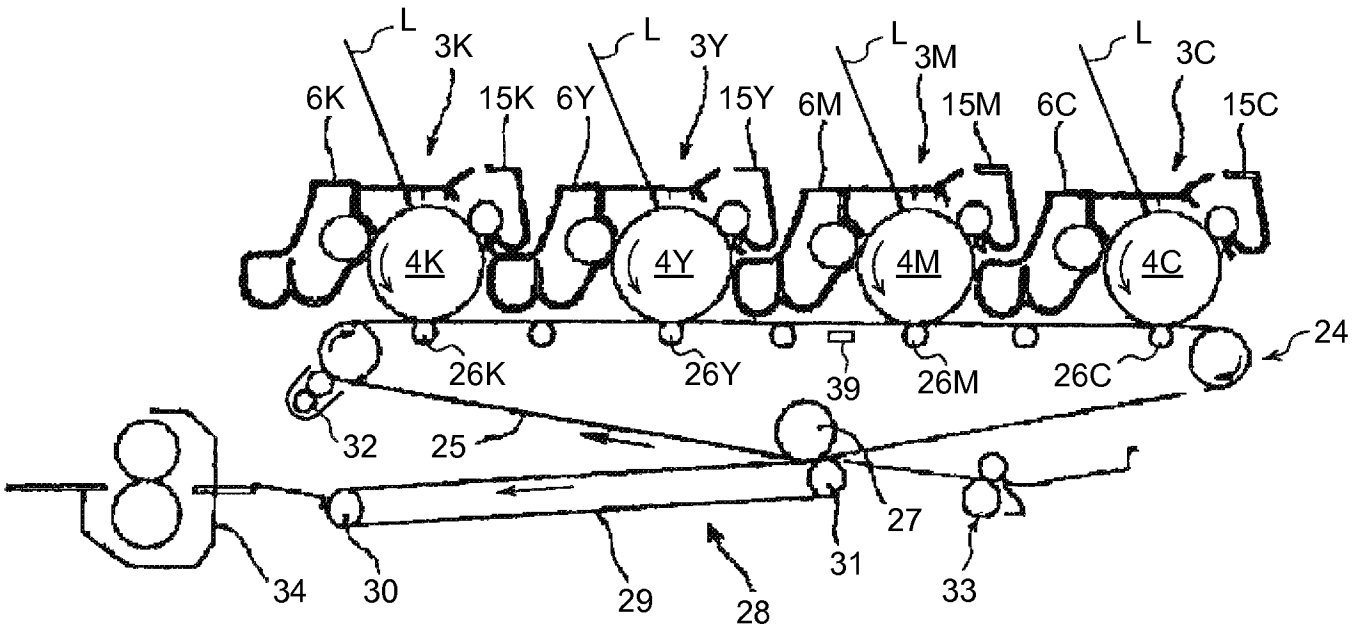
FIG. 2 is a partial configuration diagram illustrating a part of an image forming unit in the copying machine in an enlarged manner.
Figure 3:
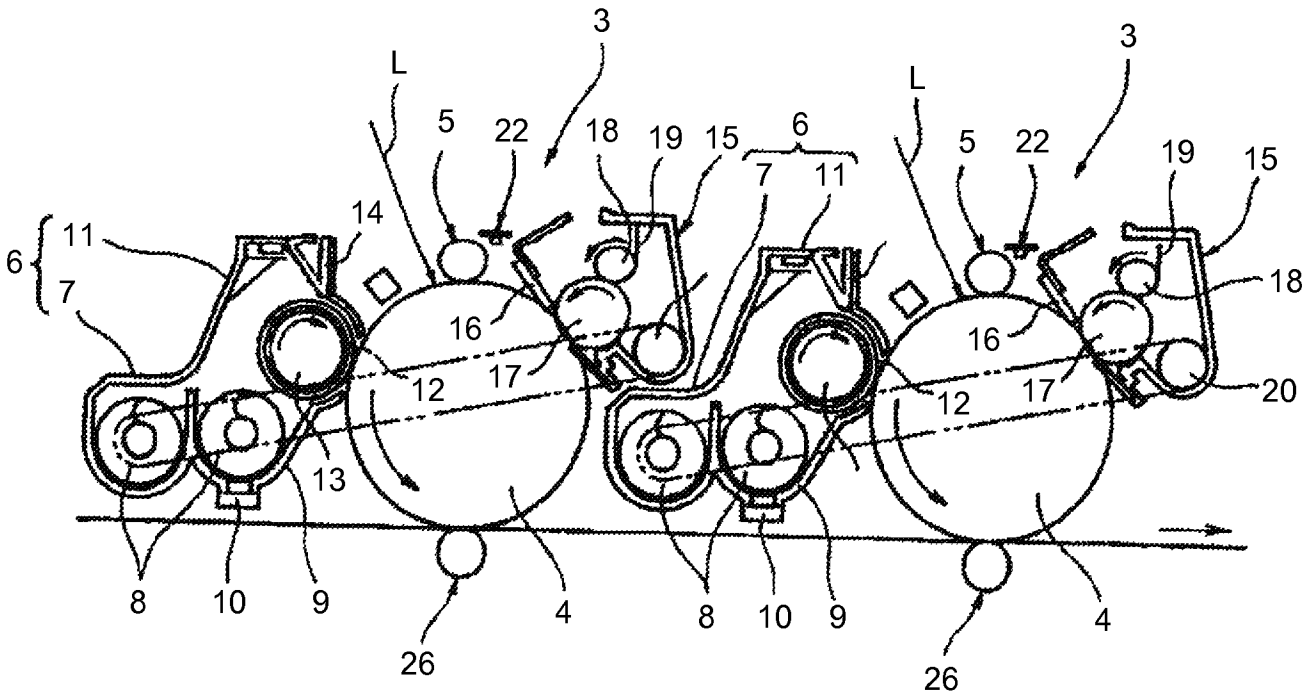
FIG. 3 is a partial enlarged view illustrating a part of a tandem portion including four imaging units in the image forming unit.

FIG. 2 is a partial configuration diagram illustrating a part of an inner configuration of the image forming unit 1 in an enlarged manner. FIG. 3 is a partial enlarged view illustrating a part of a tandem portion including four imaging units 3K, 3Y, 3M, 3C. The four imaging units 3K, 3Y, 3M, 3C have a nearly same configuration except that a toner color used by each of them is different. Thus, subscripts K, Y, M, C provided to each symbol are omitted in FIG. 3.

Each of the imaging units 3K, 3Y, 3M, 3C is a unit including the photosensitive element and various devices disposed around the photosensitive element and supported by a common supporting member. The imaging units 3K, 3Y, 3M, 3C can be attached to and removed from the body of the image forming unit 1. The imaging unit 3K for black, as an example, includes a charging device 5, a developing device 6, a drum cleaning device 15, a neutralization lamp 22, and other components around the photosensitive element 4. The copying machine has what is called a tandem configuration in which four imaging units 3K, 3Y, 3M, 3C are arranged facing an intermediate transfer belt 25 described later along the mobile direction of the intermediate transfer belt 25.

The developing device 6 develops a latent image using a two-component developer containing therein a magnetic carrier and a nonmagnetic toner (not illustrated). The developing device 6 includes a stirring unit 7 that conveys and supplies a two-component developer housed therein to a developing sleeve 12 while stirring it, and a developing unit 11 that transfers toner in the two-component developer carried by the developing sleeve 12 to the photosensitive element 4.

The stirring unit 7 is provided at a position lower than the developing unit 11, and includes two carriage screws 8 arranged in parallel to each other, a partition plate provided between the screws, a toner concentration sensor 10 provided on the bottom surface of a developing case 9, and other components.

The developing unit 11 includes the developing sleeve 12 facing the photosensitive element 4 through an opening of the developing case 9, a magnet roller 13 provided in the developing sleeve 12 so that it cannot be rotated, a doctor blade 14 whose end is brought close to the developing sleeve 12, and other components. The developing sleeve 12 is a nonmagnetic rotatable cylinder. The magnet roller 13 includes a plurality of magnetic poles sequentially arranged in a sleeve rotation direction from a position facing the doctor blade 14. Each of these magnetic poles applies magnetic force on the two-component developer on the sleeve at a given position in a rotation direction. With this configuration, the two-component developer fed from the stirring unit 7 is drawn to the surface of the developing sleeve 12 to be carried thereon, and a magnetic brush along a magnetic line is formed on the surface of the sleeve.

The layer thickness of the magnetic brush is regulated to be appropriate to pass a position facing the doctor blade 14 with rotation of the developing sleeve 12. Then, the magnetic brush is conveyed to a developing area facing the photosensitive element 4. Thereafter, the magnetic brush transfers toner onto the electrostatic latent image using a potential difference between developing bias applied on the developing sleeve 12 and the electrostatic latent image on the photosensitive element 4, thus contributing to developing. Moreover, the magnetic brush is returned to the developing unit 11 again with rotation of the developing sleeve 12, separated from the sleeve surface by the influence of a repulsive magnetic field formed between magnetic poles of the magnet roller 13, and then returned to the stirring unit 7. In the stirring unit 7, an appropriate amount of toner is supplied to the two-component developer based on the detection result by the toner concentration sensor 10. Note that as the developing device 6, there may be adopted a developing device using a one-component developer not containing a magnetic carrier, instead of one using a two-component developer.

As the drum cleaning device 15, there is adopted a drum cleaning device including a system in which a cleaning blade 16 of an elastic body is pressed against the photosensitive element 4. However, a drum cleaning device of another system may be used. In order to improve the cleaning performance, there is adopted a system in which a fur brush 17 with contact conductivity whose outer peripheral surface is brought into contact with the photosensitive element 4 is rotatable in an arrow direction in FIG. 3. The fur brush 17 also has a function of applying lubricant on the surface of the photosensitive element 4 while scraping the lubricant from solid lubricant (not illustrated) to form fine powder. A metallic electric field roller 18 applying bias on the fur brush 17 is provided so that it is rotatable in the direction of an arrow in FIG. 3, and an end of a scraper 19 is pressed against the electric field roller 18. The toner attached on the fur brush 17 is transferred onto the electric field roller 18 applying bias on the fur brush 17 while rotating in contact with the fur brush 17 in the counter direction. The toner is scraped from the electric field roller 18 by the scraper 19, and then drops on a recovery screw 20. The recovery screw 20 conveys the recovered toner toward the end of the drum cleaning device 15 in a direction orthogonal to a paper surface, and delivers it to an external recycle conveying device 21. The recycle conveying device 21 conveys the delivered toner to the developing device 6 for recycle.

The neutralization lamp 22 neutralizes the photosensitive element 4 by light irradiation. The surface of the neutralized photosensitive element 4 is charged equally by the charging device 5, and then subjected to optical writing processing by the optical writing device 2. As the charging device 5, there is used a charging device in which a charging roller on which charging bias is applied is rotated in contact with the photosensitive element 4. There may be used a scorotron charger that performs charging processing without any contact with the photosensitive element 4, for example.

In FIG. 2, K, Y, M, C toner images are formed on the photosensitive elements 4K, 4Y, 4M, 4C of the four imaging units 3K, 3Y, 3M, 3C by the process described above.

The transfer unit 24 is disposed under the four imaging units 3K, 3Y, 3M, 3C. The transfer unit 24 as a belt drive device moves the intermediate transfer belt 25 extended among a plurality of rollers in the clockwise direction in FIG. 2 while causing the intermediate transfer belt 25 to contact with the photosensitive elements 4K, 4Y, 4M, 4C. This forms primary transfer nips for K, Y, M, C in which the photosensitive elements 4K, 4Y, 4M, 4C contact with the intermediate transfer belt 25 as an endless belt. In the vicinity of the primary transfer nips for K, Y, M, C, the intermediate transfer belt 25 is pressed against the photosensitive elements 4K, 4Y, 4M, 4C by primary transfer rollers 26K, 26Y, 26M, 26C disposed in the inner side of a belt loop. Primary transfer bias is applied on each of the primary transfer rollers 26K, 26Y, 26M, 26C by a power source (not illustrated). With this configuration, in the primary transfer nip for K, Y, M, C, there are formed primary transfer fields that electrostatically move the toner images on the photosensitive elements 4K, 4Y, 4M, 4C onto the intermediate transfer belt 25. In the primary transfer nips, the toner images are sequentially overlapped and primary transferred onto the front surface of the intermediate transfer belt 25 sequentially passing the primary transfer nips for K, Y, M, C with movement thereof in the counterclockwise direction in FIG. 2. The primary transfer by overlapping forms a toner image with four overlapped colors (four color toner image) on the front surface of the intermediate transfer belt 25.

Under the transfer unit 24 in FIG. 2, there is provided the sheet carriage unit 28 that extends an endless sheet carriage belt 29 between a driving roller 30 and a secondary transfer roller 31 and moves the endless sheet carriage belt 29. The intermediate transfer belt 25 and the sheet carriage belt 29 are sandwiched between the secondary transfer roller 31 of the sheet carriage unit 28 and a lower extending roller 27 of the transfer unit 24. This forms a secondary transfer nip in which the front surface of the intermediate transfer belt 25 contacts with the front surface of the sheet carriage belt 29. Secondary transfer bias is applied on the secondary transfer roller 31 by a power source (not illustrated), whereas the lower extending roller 27 of the transfer unit 24 is grounded. This forms a secondary transfer electric field in the secondary transfer nip.

The pair of registration rollers 33 are disposed on the right side of the secondary transfer nip in FIG. 2. A registration roller sensor (not illustrated) is disposed in the vicinity of the entrance of the registration nip of the pair of registration rollers 33. Regarding the recording sheet conveyed from the sheet supply device (not illustrated) toward the pair of registration rollers 33, the conveyance of the recording sheet is stopped temporarily once a given period of time has passed since the leading end thereof is detected by the registration roller sensor, and the leading end thereof butts against the registration nip of the pair of registration rollers 33.

When the leading end of the recording sheet butts against the registration nip, the pair of registration rollers 33 restart roller rotation drive at timing allowing the recording sheet to be synchronized with the four color toner images on the intermediate transfer belt 25, and feeds the recording sheet to the secondary transfer nip. In the secondary transfer nip, the four color toner image on the intermediate transfer belt 25 is transferred altogether, as secondary transfer, onto the recording sheet by action of a secondary transfer filed and nip pressure, and mixed with a white color of the recording sheet, whereby a full color image is achieved. The recording sheet having passed the secondary transfer nip is separated from the intermediate transfer belt 25 and conveyed to the fixing device 34 with movement of the sheet carriage belt 29 while being carried on the front surface thereof.

On the surface of the intermediate transfer belt 25 having passed the secondary transfer nip, transfer residual toner that has not been transferred to the recording sheet in the secondary transfer nip is attached. The transfer residual toner is scraped and removed by a belt cleaning device contacting with the intermediate transfer belt 25.

The full color image is fixed, by pressure or heat applied in the fixing device 34, on the recording sheet conveyed to the fixing device 34. Then, the recording sheet is conveyed from the fixing device 34 to a pair of discharging rollers 35 and then discharged to the outside.

In FIG. 1, the switchback device 36 is disposed under the sheet carriage unit 28 and the fixing device 34. With this configuration, the movement direction of the recording sheet whose one surface has been subjected to image fixing processing is switched, by a switching pawl, toward a recording sheet reversing device, and the recording sheet is reversed then and enters again into the secondary transfer nip. Then, the secondary transfer processing and fixing processing of an image are performed on the other surface, and the recording sheet is discharged onto a discharge tray.

The scanner 150 fixed on the image forming unit 1 and the ADF 51 fixed on the scanner 150 include a fixed reading unit and a moving reading unit 152. The moving reading unit 152 is disposed directly under a second contact glass (not illustrated) fixed on an upper wall of a casing of the scanner 150 so as to be in contact with a document MS, and can move an optical system including a light source, a reflecting mirror, and other components in the horizontal direction in FIG. 1. Then, in the process of moving the optical system from the left side to the right side in FIG. 1, light emitted from the light source is reflected by a document (not illustrated) placed on the second contact glass and passed through a plurality of reflecting mirrors, so that an image reading sensor 153 fixed on the scanner body receives the light.

The fixed reading unit has a first surface fixed reading unit 151 disposed in the scanner 150 and a second surface fixed reading unit (not illustrated) disposed in the ADF 51. The first surface fixed reading unit 151 including a light source, a reflecting mirror, an image reading sensor, such as a charge coupled device (CCD), and other components is disposed directly under the first contact glass (not illustrated) fixed on the upper wall of the casing of the scanner 150 so as to contact with a document MS. When the document MS conveyed by the ADF 51 described later passes on the first contact glass, the light emitted from the light source is sequentially reflected by the document surface and passed through reflecting mirrors, so that the image reading sensor receives the light. With this configuration, the first surface fixed reading unit 151 scans the first surface of the document MS without moving the optical system including the light source, the reflecting mirror, and other components. The second surface fixed reading unit scans the second surface of the document MS having passed the first surface fixed reading unit 151.

Figure 4:
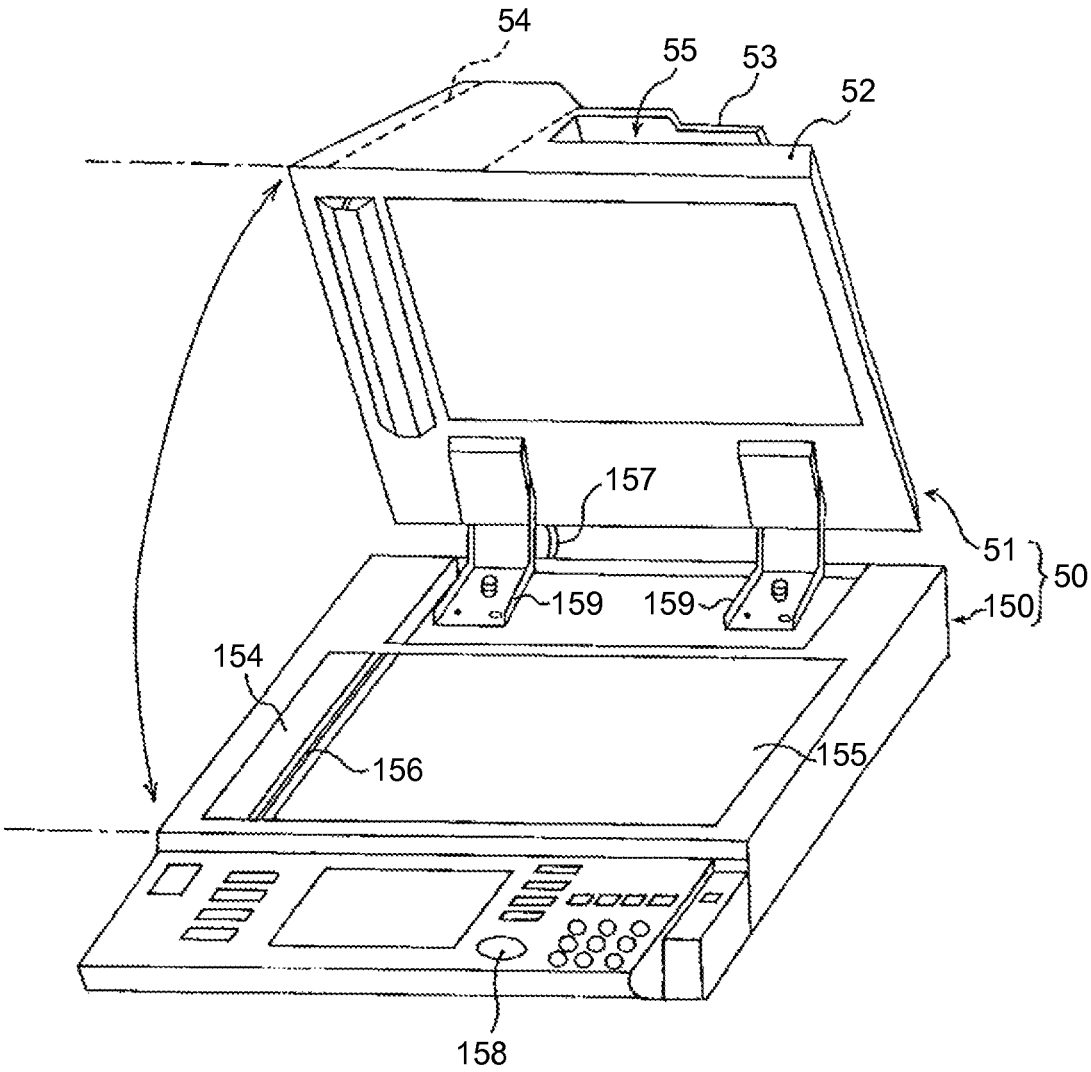
FIG. 4 is a perspective view illustrating a scanner and an automatic document feeder (ADF) of the copying machine.

The ADF 51 disposed on the scanner 150 includes, in a body cover 52, a document placement table 53 for placing thereon a document MS to be scanned, a conveying unit 54 for conveying the document MS as a sheet member, a document stack table 55 for stacking a scanned document MS, and other components. As illustrated in FIG. 4, the ADF 51 is supported by hinges 159 fixed on the scanner 150 so that the ADF 51 can swing in the vertical direction. The ADF 51 moves like an opening/closing door by such swing and, in the opening state, the first contact glass 154 and the second contact glass 155 on the upper surface of the scanner 150 are exposed. In the case of a one-side stitched document such as a book formed by stitching a corner of a document bundle, documents cannot be separated one by one, which disables conveyance by the ADF. Thus, in the case of the one-side stitched document, the ADF 51 is opened as illustrated in FIG. 4, and the one-side stitched document is placed on the second contact glass 154 so that a page to be scanned is open facing downward before the ADF 51 is closed. Then, the moving scanning unit 152 of the scanner 150 illustrated in FIG. 1 is controlled to read out an image on the page.

In the case of a document bundle formed by simply piling a plurality of independent documents MS, the ADF 51 automatically conveys the documents MS one by one and the documents MS are sequentially read with the first surface fixed reading unit 151 in the scanner 150 or the second fixed reading unit in the ADF 51. In this case, after the document bundle is set on the document placement table 53, a copy start button (not illustrated) is pressed. Then, the ADF 51 feeds the documents MS of the document bundle placed on the document placement table 53 sequentially from the top to the conveying unit 54, and conveys the documents MS toward the document stack table 55 while reversing them. In this conveying process, the documents MS pass directly above the first surface fixed reading unit 151 of the scanner 150 immediately after the documents MS are reversed. Here, an image on the first surface of the document MS is read out by the first surface fixed reading unit 151 of the scanner 150.

Regarding the copying machine, a face on the near side in a direction orthogonal to the paper surface in FIG. 1 is a front surface, and a face on the far side is a back surface. In FIG. 1, the depth direction thereof is along the front-back direction of the copying machine, and a horizontal direction thereof is along the left-right direction of the copying machine. The large-capacity sheet feeding unit 200 includes a stock bundle housing unit 210 and a sheet feeder 280 arranged in the left-right direction of the copying machine, and a sheet bundle can be housed in each of them. Of the stock bundle housing unit 210 and the sheet feeder 280, only the sheet feeder 280 feeds recording sheets housed therein to the sheet feeding path 44, and the stock bundle housing unit 210 does not have a function of feeding sheets to the sheet feeding path 44. Instead, the stock bundle housing unit 210 has a transfer function of transferring a sheet bundle housed therein into the sheet feeder 280 when no recording sheet is available in the sheet feeder 280. The sheet bundle is housed not only in the sheet feeder 280 but also in the sheet bundle housing unit 210, which reduces the number of times of sheet bundle refilling operation performed by an operator and improves maintainability.

Figure 5:
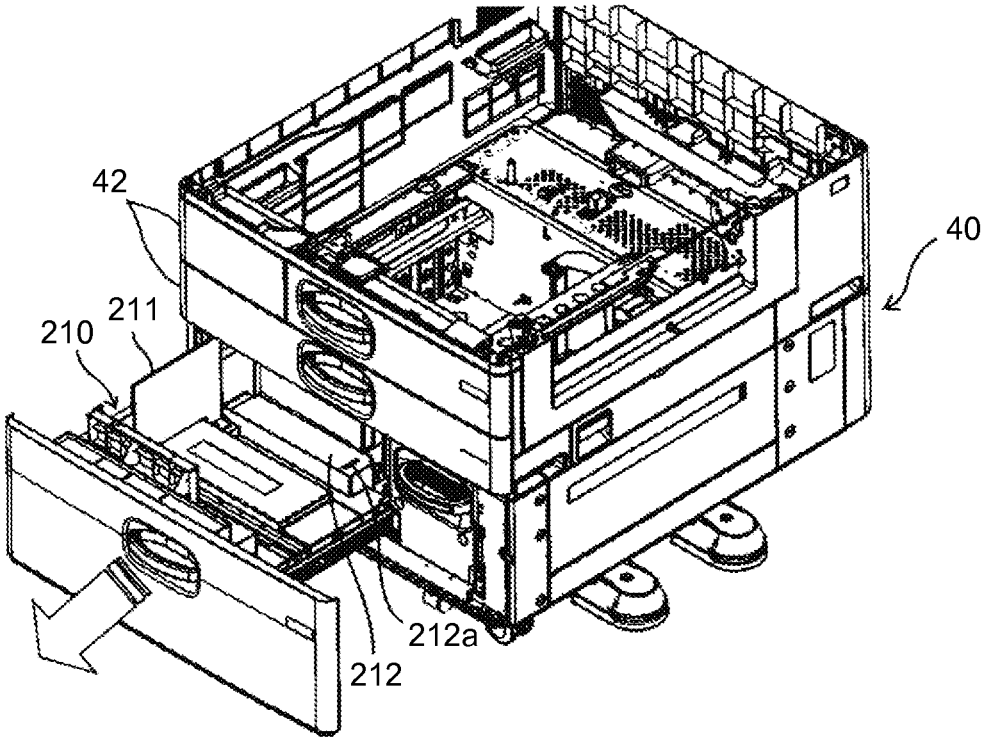
FIG. 5 is a perspective view illustrating a sheet supply device of the copying machine.

FIG. 5 is a perspective view illustrating the sheet supply device 40. In the copying machine, it is possible to pull out two sheet feeding cassettes 42 and the stock bundle housing unit 210 of the large-capacity sheet feeding unit (200 in FIG. 1) to the front side of the device from the apparatus body, as illustrated in FIG. 5, or press them into the apparatus body. Regarding the large-capacity sheet feeding unit (200 in FIG. 1), when the stock bundle housing unit 210 is pulled out from or pressed (inserted) into the apparatus body, the sheet feeding unit (280 in FIG. 1) remains in the apparatus body. Then, in the apparatus body, the stock bundle housing unit 210 is positioned on the left side of the sheet feeding unit (280 in FIG. 1).

The stock bundle housing unit 210 is provided with a transfer fence 211 extending in the front-back direction of the apparatus body so that the transfer fence 211 can move in the left-right direction of the copying machine body. The transfer fence 211 has a position at the left end of the stock bundle housing unit 210 as a home position, as illustrated in FIG. 5. When a control unit (not illustrated) drives a driving unit if necessary after the stock bundle housing unit 210 in which the sheet bundle is housed is pressed into the apparatus body, the transfer fence 211 slides from the home position to the right side of the apparatus body. With this configuration, the sheet bundle in the stock bundle housing unit 210 is pressed from the left side to the right side of the apparatus body, and eventually transferred into the sheet feeding unit (280 in FIG. 1) on the right side of the stock bundle housing unit 210. After this transfer, the transfer fence 211 is returned to the home position by reverse drive of the driving unit.

On the bottom plate 212 of the stock bundle housing unit 210, an elongated rectangular opening 212*a* is provided in the posture extending in the front-back direction of the apparatus body. The opening 212*a* allows a sheet contact portion of a swing member (not illustrated) positioned under the bottom plate 212 to project above the sheet placement surface that is a surface of the bottom plate 212.

Figure 6:
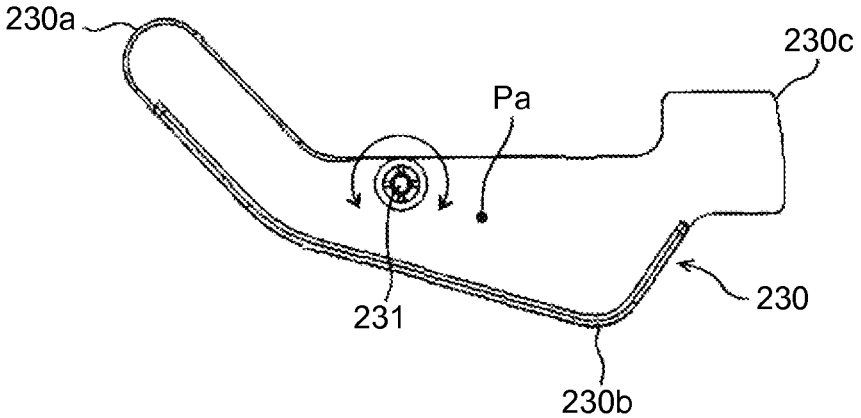
FIG. 6 is a side view illustrating a swing member disposed under a bottom plate of a stock bundle housing unit in the sheet supply device.

FIG. 6 is a side view of a swing member 230 disposed under the bottom plate (212 in FIG. 5). The flat swing member 230 is held in the stock bundle housing unit (210 in FIG. 5) so that a swing axis member 231 penetrates through a through hole (not illustrated) penetrating in the thickness direction, and can swing about the swing axis member 231, as illustrated with an arrow in FIG. 6. On the one end side (left side in FIG. 6) relative to the swing axis member 231, there is provided a sheet contact portion 230*a* to be brought into contact with a sheet bundle placed on the sheet placement surface of the stock bundle housing unit. Depending on a swing stop position of the swing member 230, the sheet contact portion 230*a* projects above the sheet placement surface through the opening 212*a* of the bottom plate 212 illustrated in FIG. 5. In the swing member 230, a swing stop position at which the sheet contact portion 230*a* projects above the sheet placement surface (surface of the bottom plate 212) is a projection position. In the case where a sheet bundle is placed on the sheet placement surface, even when the swing member 230 inclines to move to the projection position, the movement is prevented. Thus, the swing member 230 is restrained at a non-projection position. The non-projection position is a swing stop position at which the sheet contact portion 230*a* does not project above the sheet placement surface.

Hereinafter, with respect to the swing member 230 in FIG. 6, the side on which the sheet contact portion 230*a* is provided, relative to the swing axis member 231, is referred to as one end side, and the opposite side is referred to as the other end side. In FIG. 6, Pa represents the center of gravity of the swing member 230. The center of gravity Pa is positioned on the other end side relative to the swing axis member 231, as illustrated in FIG. 6. Thus, when no external force is applied on the swing member 230, the other end side of the swing member 230 does not remain in the state illustrated in FIG. 6, and inclines to move downward further as compared with the state illustrated in FIG. 6. This rotates the swing member 230 in the clockwise direction in FIG. 6 by a given angle from the state illustrated therein. The rotation stop position here is a position at which the center of gravity Pa is directly under the swing axis member 231.

On the other end side relative to the swing axis member 231, there are provided a portion 230*c* to be detected by an optical sensor described later, and a base butting portion 230*b* to butt against a base board (not illustrated) of the stock bundle housing unit (210 in FIG. 5).

Figure 7:
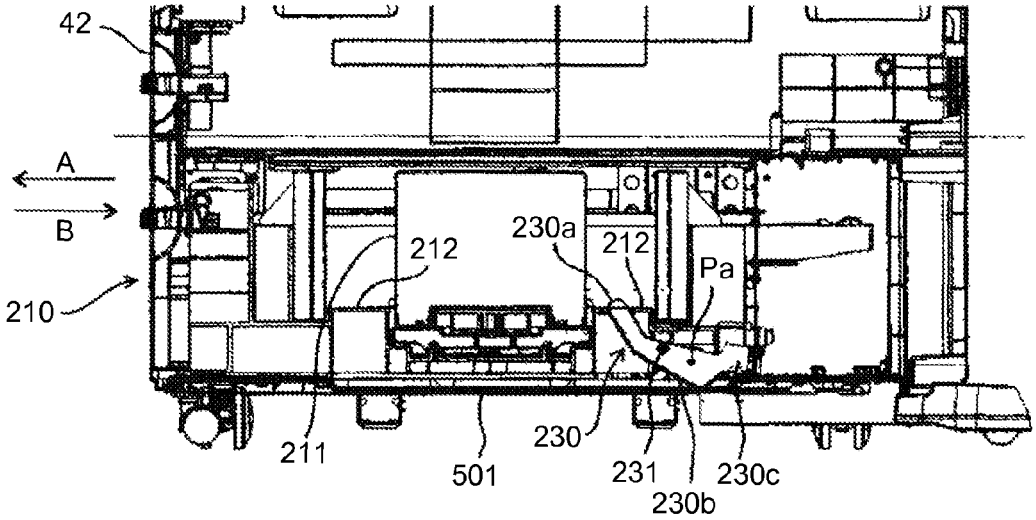
FIG. 7 is a transverse cross section illustrating the stock bundle housing unit completely pressed in the apparatus body.

FIG. 7 is a transverse cross section illustrating the stock bundle housing unit 210 completely pressed in the apparatus body. FIG. 7 illustrates the stock bundle housing unit 210 from the right side of the apparatus body. The near side in the direction orthogonal to the paper surface in FIG. 7 corresponds to the right side of the apparatus body, and the far side corresponds to the left side of the apparatus body. The direction of the arrow A in FIG. 7 represents the pulling direction of the stock bundle housing unit 210 from the apparatus body, and the direction of the arrow B in FIG. 7 represents the pressing direction (inserting direction) of the stock bundle housing unit 210 into the apparatus body. In the copying machine, the stock bundle housing unit 210 is slid in the direction of the arrow A from the back side to the front side of the apparatus body so as to pull it out from the apparatus body.

Figure 8:
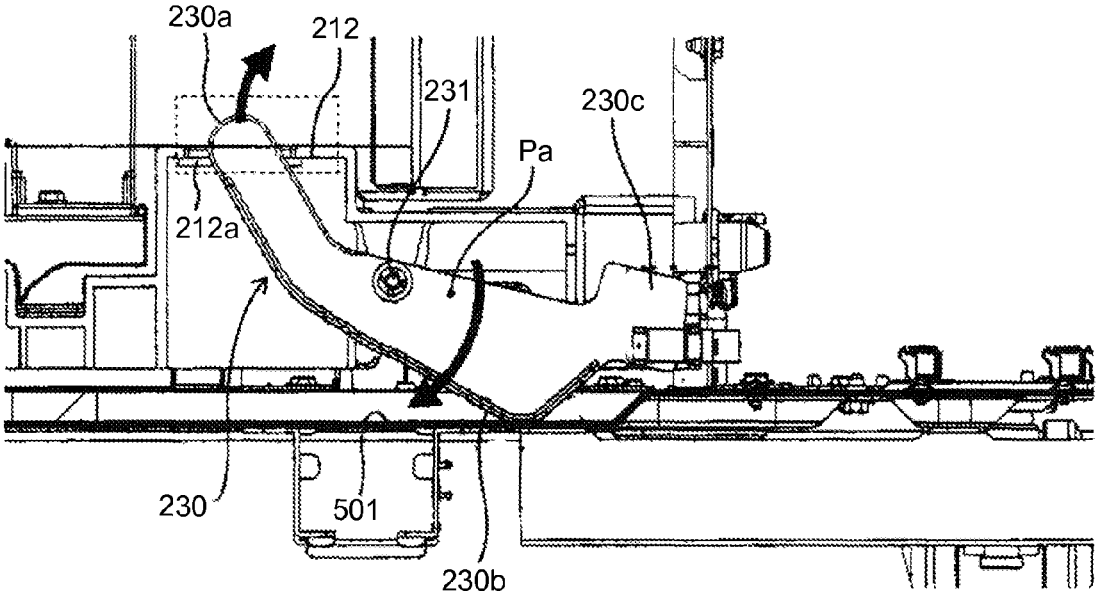
FIG. 8 is a cross section illustrating the swing member in FIG. 7 in an enlarged manner.

FIG. 8 is a cross section illustrating the swing member 230 in FIG. 7 in an enlarged manner. As described above, when no external force is applied, the swing member 230 stops swinging in the posture in which the center of gravity Pa is positioned directly under the swing axis member 231. However, FIG. 8 does not illustrate such a posture. This is because the base butting portion 230*b* of the swing member 230 butts against a base plate 501 of the apparatus body. When there is no sheet bundle in the stock bundle housing unit 210 housed in the apparatus body, the swing member 230 stops swinging in a manner that the base butting portion 230*b* thereof butts against the base plate 501 of the apparatus body, as illustrated in FIG. 8. Here, the sheet contact portion 230*a* of the swing member 230 is positioned above the sheet placement surface of the bottom plate 212, as illustrated in FIG. 8. That is, the swing member 230 stops swinging at the projection position.

On the left side of the apparatus body relative to the swing member 230 (the back side in a direction orthogonal to the paper surface in FIG. 8), there is provided an optical sensor, such as a transmission type photo sensor, a reflection type photo sensor, and other components. However, in FIG. 8, the optical sensor is hidden behind the portion 230*c* to be detected of the swing member 230 and cannot be viewed. In the state illustrated in FIG. 8, the portion 230*c* to be detected positioned in front of the optical sensor is detected by the optical sensor. Thus, the detection of the portion 230*c* to be detected by the optical sensor in the state where the stock bundle housing unit 210 is housed in the apparatus body indicates that no sheet bundle exists in the stock bundle housing unit 210, that is, "absence of sheet bundle".

Figure 9:
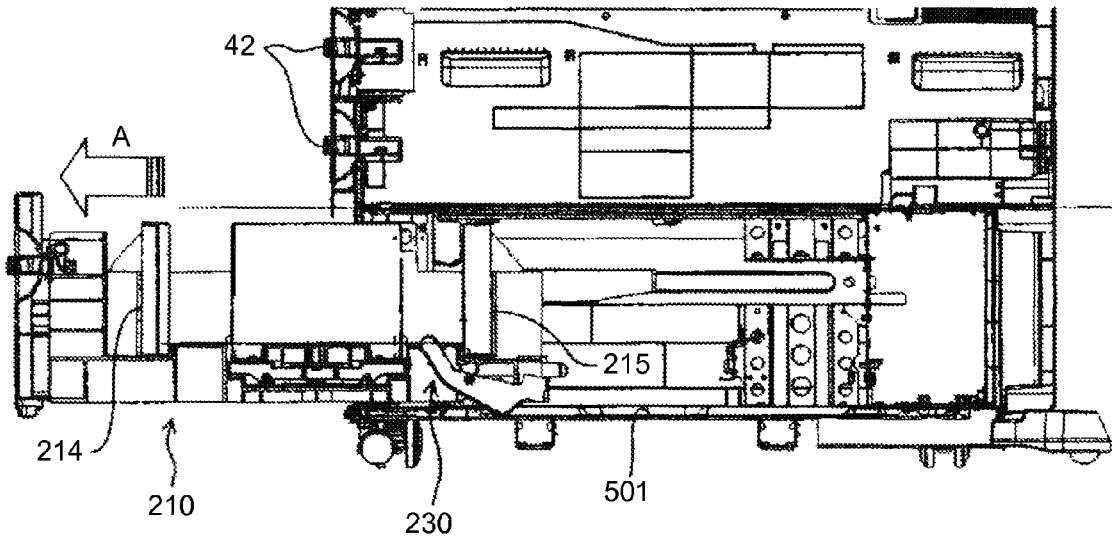
FIG. 9 is a cross section illustrating the stock bundle housing unit being pulled out from the apparatus body.

FIG. 9 is a cross section illustrating the stock bundle housing unit 210 being pulled out from the apparatus body. In the state illustrated in FIG. 9, the stock bundle housing unit 210 is not completely pulled out from the apparatus body. In the vicinity of the front end of the stock bundle housing unit 210 (vicinity of the left end of FIG. 9), a front fence 214 for controlling one end position of a sheet bundle stands in the posture extending in the left-right direction of the apparatus body (a depth direction in FIG. 9). In the vicinity of the back end of the stock bundle housing unit 210 (vicinity of the right end of FIG. 9), a back fence 215 for controlling the other end position of the sheet bundle stands in the posture extending in the left-right direction of the apparatus body. The position at which the back fence 215 is completely pulled out from the apparatus body is a position at which the stock bundle housing unit 210 is pulled out completely. The stock bundle housing unit 210 illustrated in FIG. 9 is positioned 10 cm before such a position. Note that no sheet bundle exists in the stock bundle housing unit 210 illustrated in FIG. 9.

Figure 10:
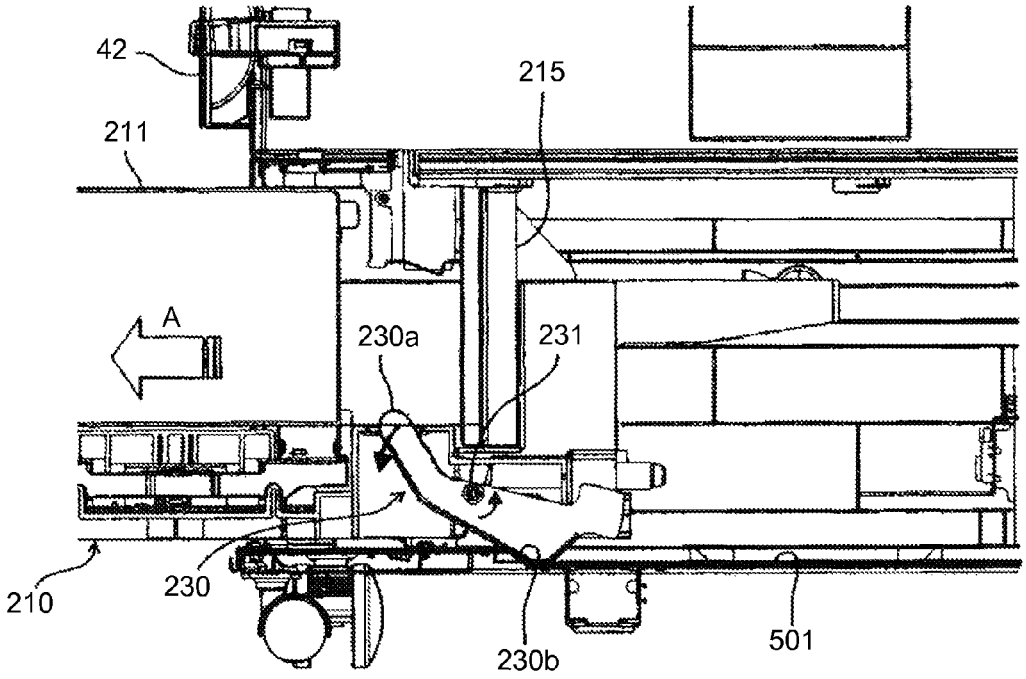
FIG. 10 is a cross section illustrating a configuration of the swing member in FIG. 9 and the periphery thereof in an enlarged manner.

FIG. 10 is a cross section illustrating a configuration of the swing member 230 in FIG. 9 and the periphery thereof in an enlarged manner. The swing member 230 is a component of the stock bundle housing unit 210, and moves together with the stock bundle housing unit 210. Once the stock bundle housing unit 210 is pulled out from the apparatus body to the position illustrated in FIG. 10, the posture of the swing member 230 starts changing. This is because there is a difference in height of the base plate 501 of the apparatus body between the front side and the back side of the apparatus body. The base plate 501 is slightly higher on the front side than the back side of the apparatus body. The base plate 501 is provided with a taper gradually increased in height from the back side to the front side so that the height difference does not become a step. Once the stock bundle housing unit 210 is pulled out to the position 10 cm before the state where it is pulled out completely from the apparatus body, the butting portion 230*b* of the swing member 230 starts to contact with the taper of the base plate 501, as illustrated in FIG. 10. As the stock bundle housing unit 210 is pulled out further to the front side of the copying machine body (left side in FIG. 10), the butting portion 230*b* gradually moves upward on the taper. With this configuration, the swing member 230 rotates in the counterclockwise direction in FIG. 10 about the swing axis member 231, as illustrated in FIG. 10 with arrows.

Figure 11:
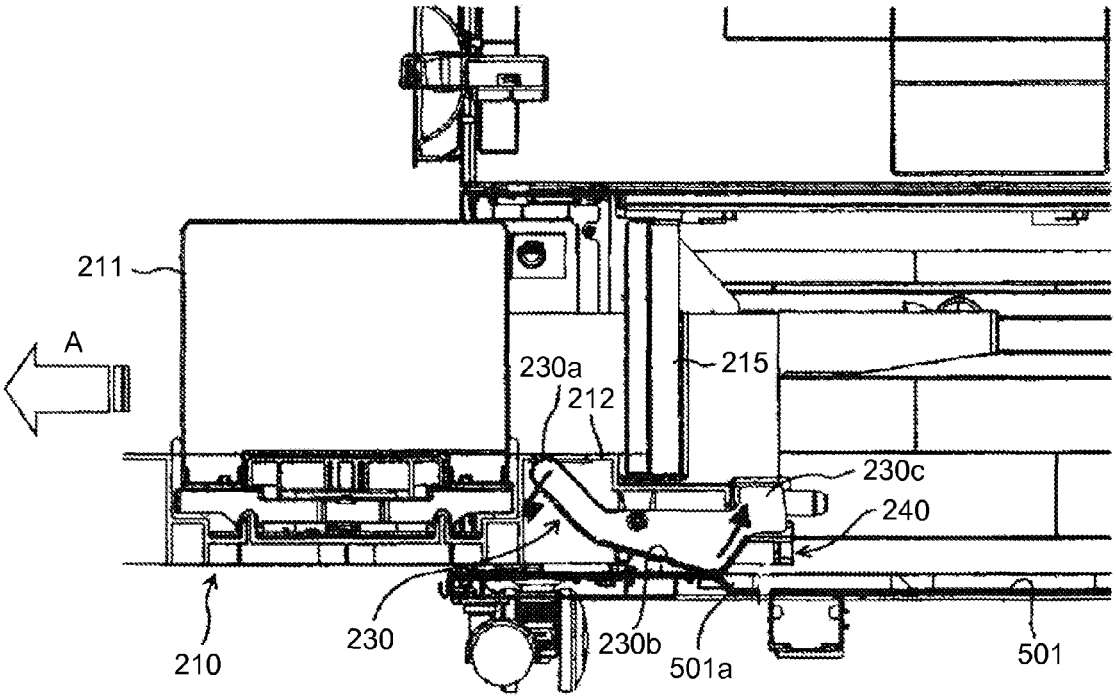
FIG. 11 is a cross section partially illustrating the stock bundle housing unit pulled out further as compared with FIG. 10.

When the stock bundle housing unit 210 is further pulled out from the apparatus body, and the butting portion 230*b* of the swing member 230 moves up to the end of the taper 501*a* of the base plate 501, the swing member 230 has the following posture. That is, the swing of the swing member 230 is stopped at a non-projection position at which the sheet contact portion 230*a* does not project above the bottom plate 212. In this posture, the portion 230*c* to be detected of the swing member 230 is retracted from the front of an optical sensor 240. Thus, the optical sensor 240 does not detect the portion 230*c* to be detected. The detection of the portion 230*c* to be detected by the optical sensor 240 in the state where the stock bundle housing unit 210 is completely pressed in the apparatus body indicates that no sheet bundle exists in the stock bundle housing unit 210, that is, "absence of sheet bundle". However, when the stock bundle housing unit 210 is pulled out from the apparatus body, as illustrated in FIG. 11, the optical sensor 240 does not detect the portion 230*c* to be detected even if no sheet bundle exists. Therefore, the presence or absence of a sheet bundle is determined based on the detection result by the optical sensor 240 obtained when the sheet bundle housing unit 210 is completely pressed in the apparatus body. Note that FIG. 11 illustrates the state in which the back fence 215 of the stock bundle housing unit 210 is still in the apparatus body, and thus the stock bundle housing unit 210 is not pulled out completely from the apparatus body.

Figure 12:
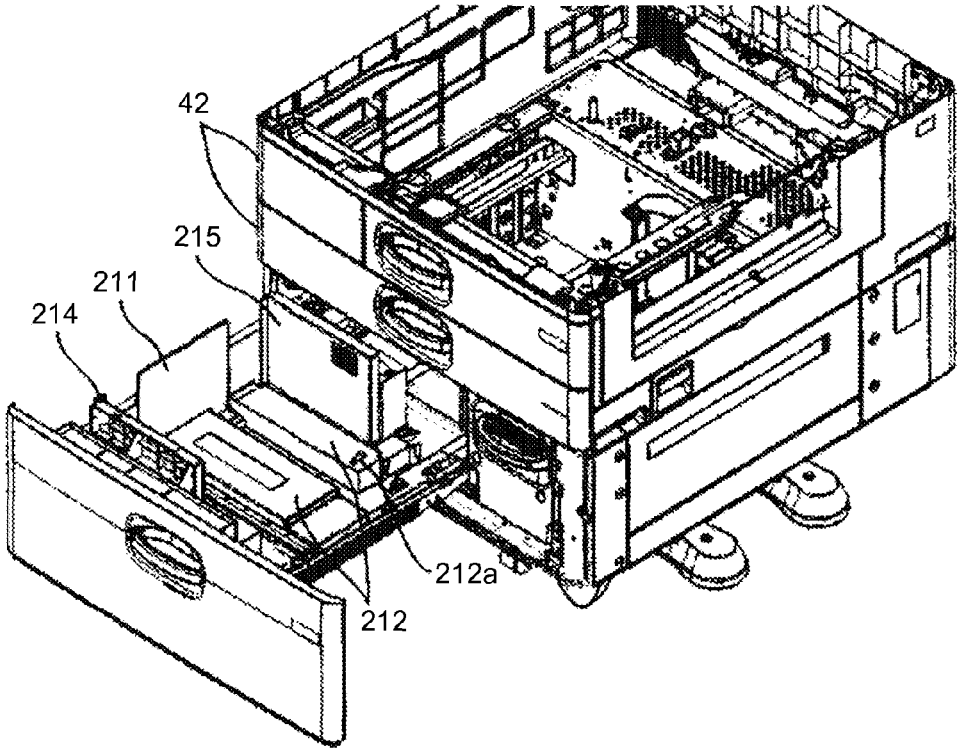
FIG. 12 is a perspective view illustrating the sheet supply device from which the stock bundle housing unit is pulled out completely.
Figure 13:
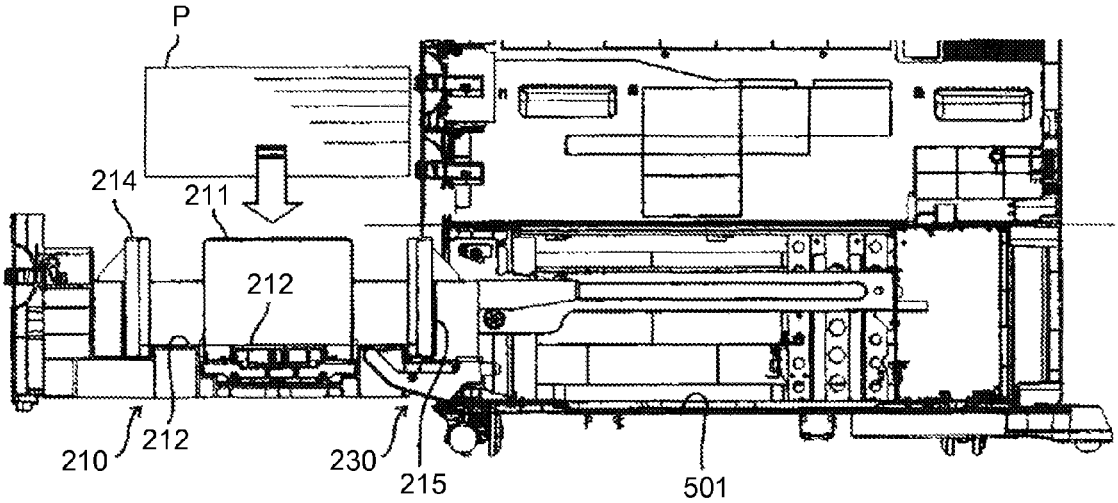
FIG. 13 is a cross section illustrating the stock bundle housing unit pulled out completely.
Figure 14:
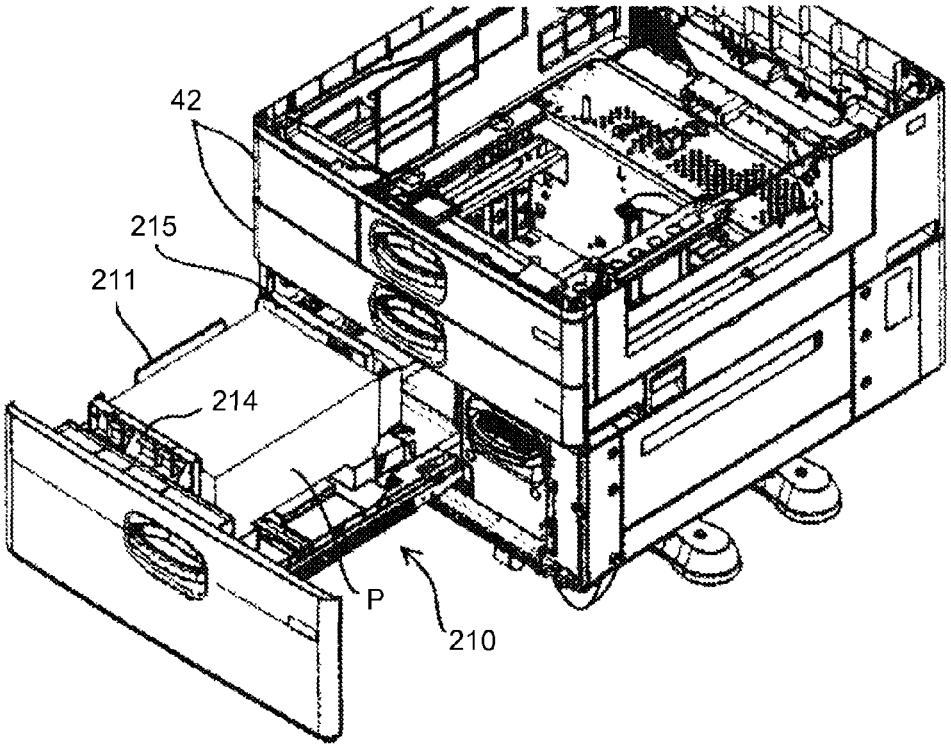
FIG. 14 is a perspective view illustrating the sheet supply device in the state where a sheet bundle is set in the stock bundle housing unit pulled out completely.
Figure 15:
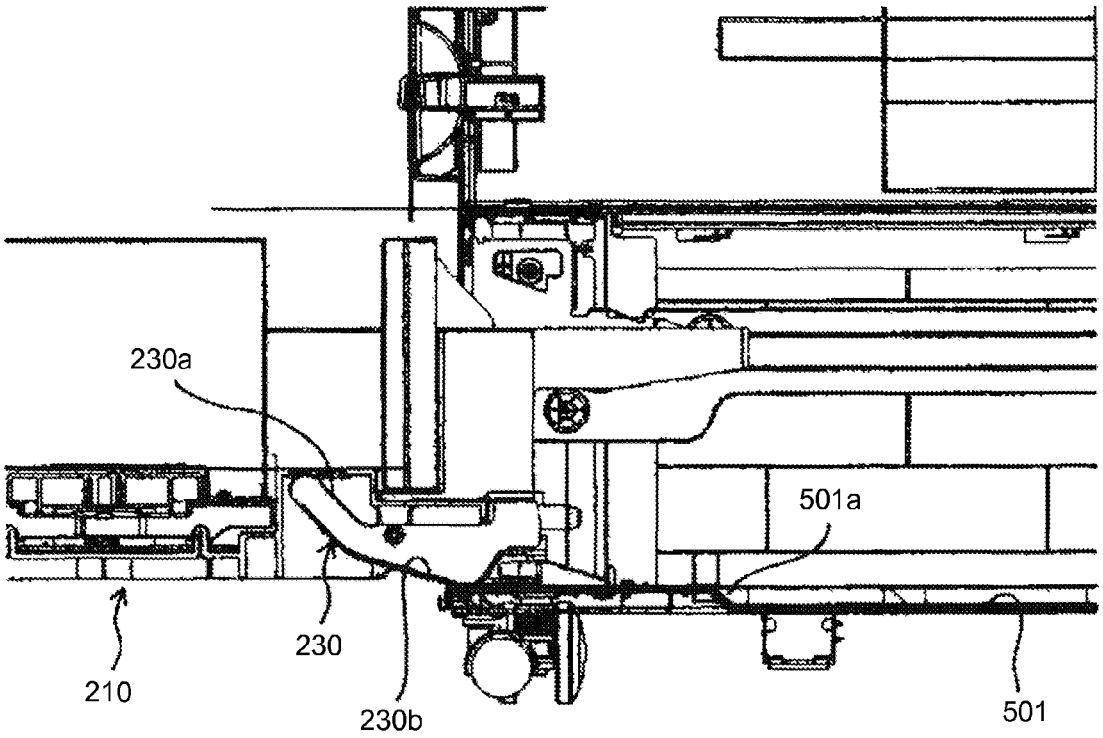
FIG. 15 is a cross section illustrating a configuration of the swing member in FIG. 13 and the periphery thereof in an enlarged manner.
Figure 16:
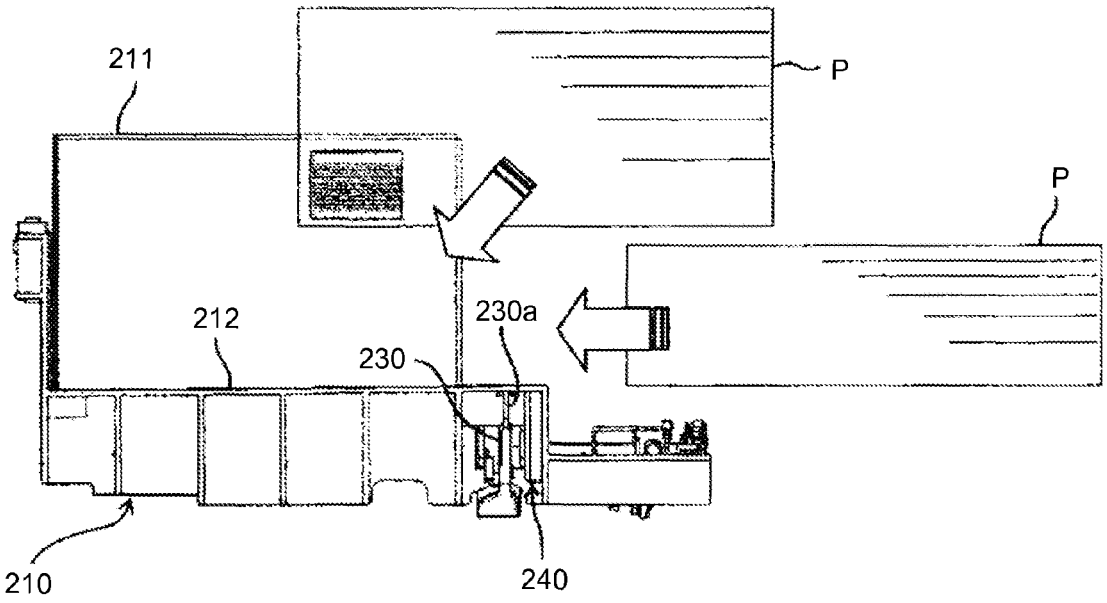
FIG. 16 is a schematic view for explaining the behavior of the sheet bundle when the sheet bundle is set in the stock bundle housing unit.

When the stock bundle housing unit 210 is pulled out completely from the apparatus body, the back fence 215 of the stock bundle housing unit 210 is pulled out completely from the apparatus body, as illustrated in FIG. 12. Once the stock bundle housing unit 210 is pulled out to such a state, an operator gradually lowers a sheet bundle toward a part between the front fence 214 and the back fence 215 in the entire area of the sheet placement surface formed by the surface of the bottom plate 212, as illustrated in FIG. 13, and sets the sheet bundle between the fences, as illustrated in FIG. 14. When the sheet bundle is set, the sheet contact portion 230*a* of the swing member 230 does not project above the sheet placement surface, and thus the sheet bundle is not in contact with the sheet contact portion 230*a*, as illustrated in FIG. 15. When the sheet bundle is set, the sheet bundle is often moved to a direction deviating from the vertical direction for alignment, instead of moving downward in the vertical direction relative to the sheet placement surface. As illustrated in FIG. 16, even when the sheet bundle is moved in the horizontal direction or a diagonal direction for alignment at a position immediately before the sheet placement surface or at a position in contact with the sheet placement surface, the sheet bundle is not caught on the sheet contact portion 230*a* or damaged by rubbing with the sheet contact portion 230*a*. Therefore, it is possible to refill the sheet bundle housing unit 210 with the sheet bundle without allowing the sheet bundle to be caught on the sheet contact portion 230*a* or damaged by rubbing with the sheet contact portion 230*a*.

Figure 17:
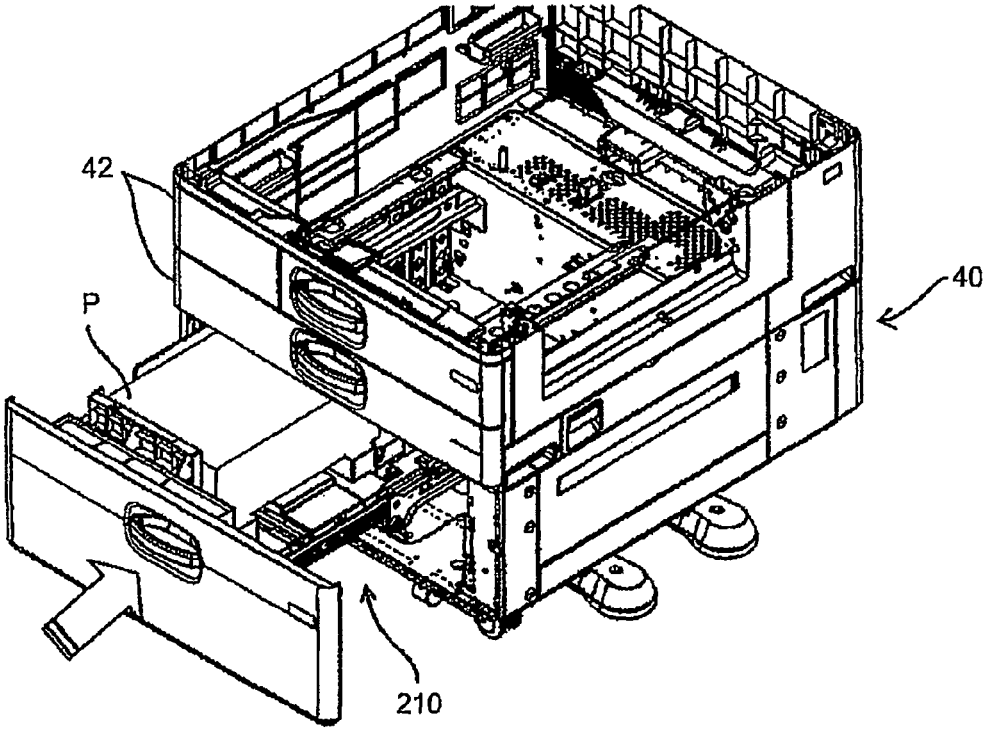
FIG. 17 is a perspective view illustrating the sheet supply device in the state where the stock bundle housing unit in which the sheet bundle is set starts to be closed into the apparatus body.

FIG. 17 is a perspective view illustrating the sheet supply device 40 in the state where the stock bundle housing unit 210 in which the sheet bundle is set starts to be closed into the apparatus body. When the stock bundle housing unit 210 starts to be closed, as illustrated in FIG. 17, the base butting portion 230*b* of the swing member 230 butts against the front end in the front-back direction of the base plate 501. The front end of the base plate 501 is positioned on the front side of the apparatus body relative to the taper 501*a*, and is higher than the back side. Thus, the swing member 230 moves together with the stock bundle housing unit 210 toward the back side of the apparatus body while keeping the posture in which the sheet contact portion 230*a* is stopped at the non-projection position at which it does not project above the sheet placement surface. Here, tiny space is formed between the sheet contact portion 230*a* and the sheet bundle on the sheet placement surface.

Figure 18:
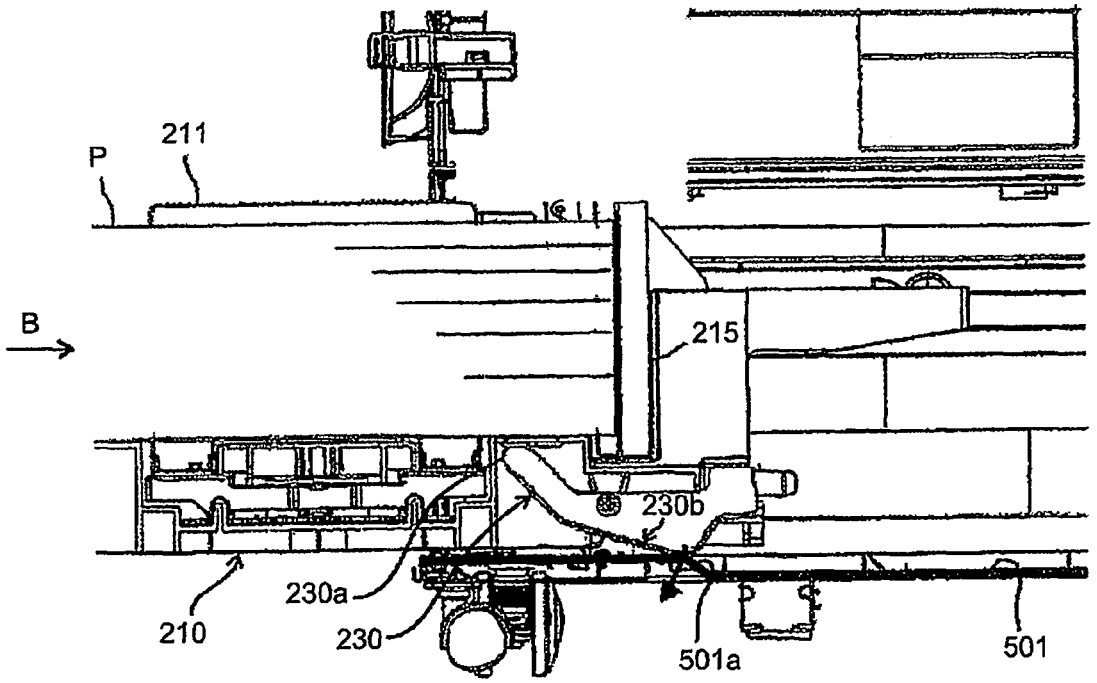
FIG. 18 is a cross section partially illustrating the stock bundle housing unit in the same state.

When the stock bundle housing unit 210 is further pressed (inserted) into the apparatus body, the base butting portion 230*b* of the swing member 230 moves to the position facing the taper 501*a* of the base plate 501. Then, when the base butting portion 230*b* starts to move downward along the slope of the taper 501*a*, the swing member 230 rotates in the clockwise direction in FIG. 18 about the swing axis member 231. However, the swing member 230 rotates by only a small angle. Immediately after the rotation starts, the sheet contact portion 230*a* of the swing member 230 butts against the sheet bundle, which prevents further rotation. Here, the height position of the sheet contact portion 230*a* is nearly same as that of the sheet placement surface (surface of the bottom plate 212) and is not above the sheet placement surface. Therefore, the position of the swing member 230 in a swing direction remains at the non-projection position.

Figure 19:
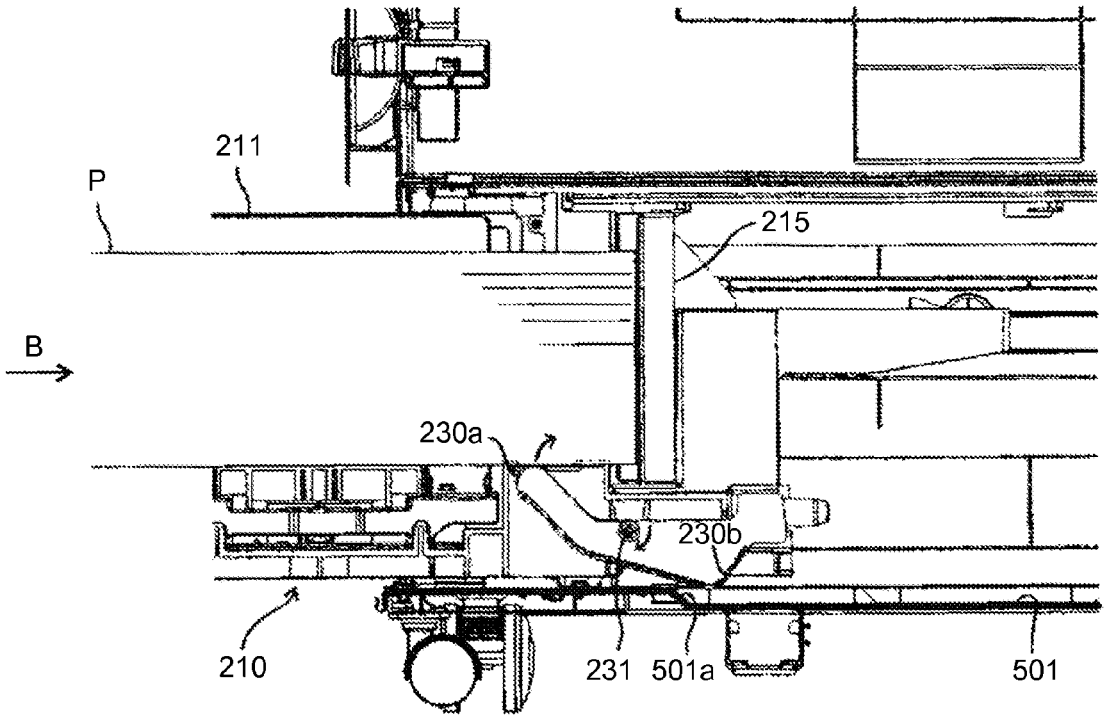
FIG. 19 is a cross section partially illustrating the stock bundle housing unit pressed in further as compared with FIG. 18.

Thereafter, when the stock bundle housing unit 210 is further pressed (inserted) into the apparatus body, as illustrated in FIG. 19, the base butting portion 230*b* of the swing member 230 moves to the back side of the apparatus body relative to the position facing the taper 501*a* of the base plate 501. Here, the rotation of the swing member 230 in the clockwise direction is prevented by butting of the sheet contact portion 230*a* against the sheet bundle. Thus, the swing member 230 keeps the posture stopped at the non-projection position in a swing direction. With this configuration, the base butting portion 230*b* of the swing member 230 does not butt against the base plate 501, and keeps a given distance from the base plate 501.

Figure 20:
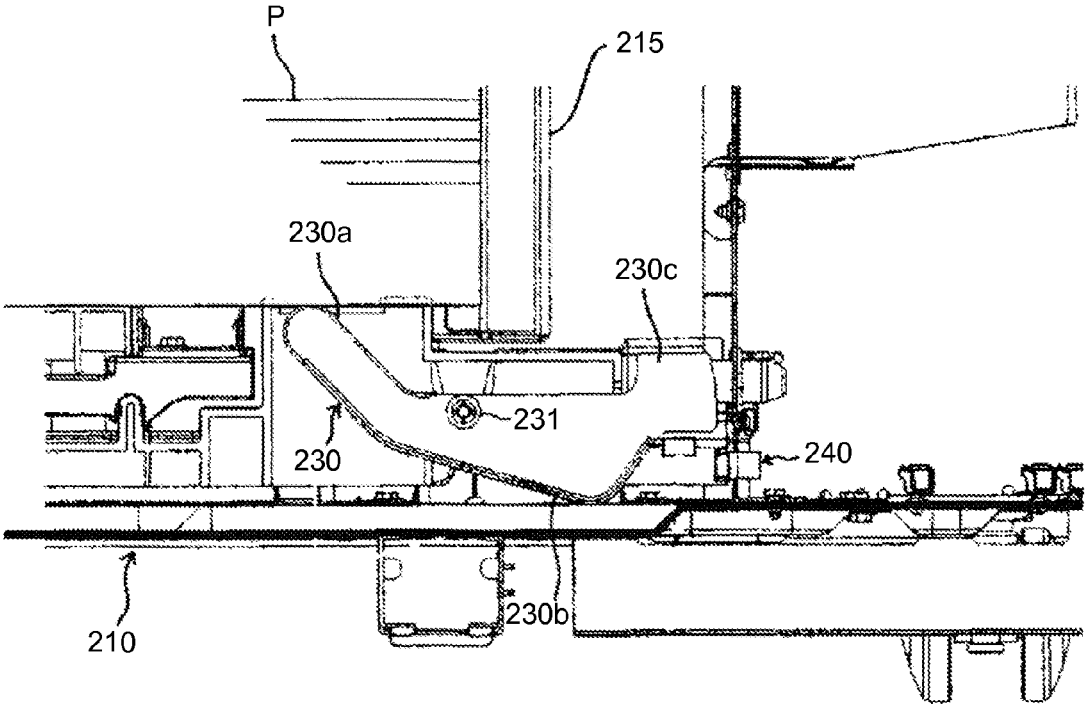
FIG. 20 is a cross section partially illustrating the stock bundle housing unit pressed in completely.

Even when the stock bundle housing unit 210 is completely pressed in the apparatus body, the rotation of the swing member 230 in the clockwise direction in FIG. 20 is prevented by butting of the sheet contact portion 230*a* against the sheet bundle, as illustrated in FIG. 20. Thus, the swing member 230 keeps the posture stopped at the non-projection position in a swing direction at which the sheet contact portion 230 does not project above the sheet placement surface.

The optical sensor 240 is fixed in the apparatus body. When the stock bundle housing unit 210 is completely pressed in the apparatus body, the portion 230*c* to be detected of the swing member 230 moves to the position of the optical sensor 240 in the front-back direction of the apparatus body. However, in the state where the swing member 230 keeps the posture described above, the portion 230*c* to be detected is positioned higher than the optical sensor 240. Thus, the portion 230*c* to be detected is not detected by the optical sensor 240.

Figure 21:
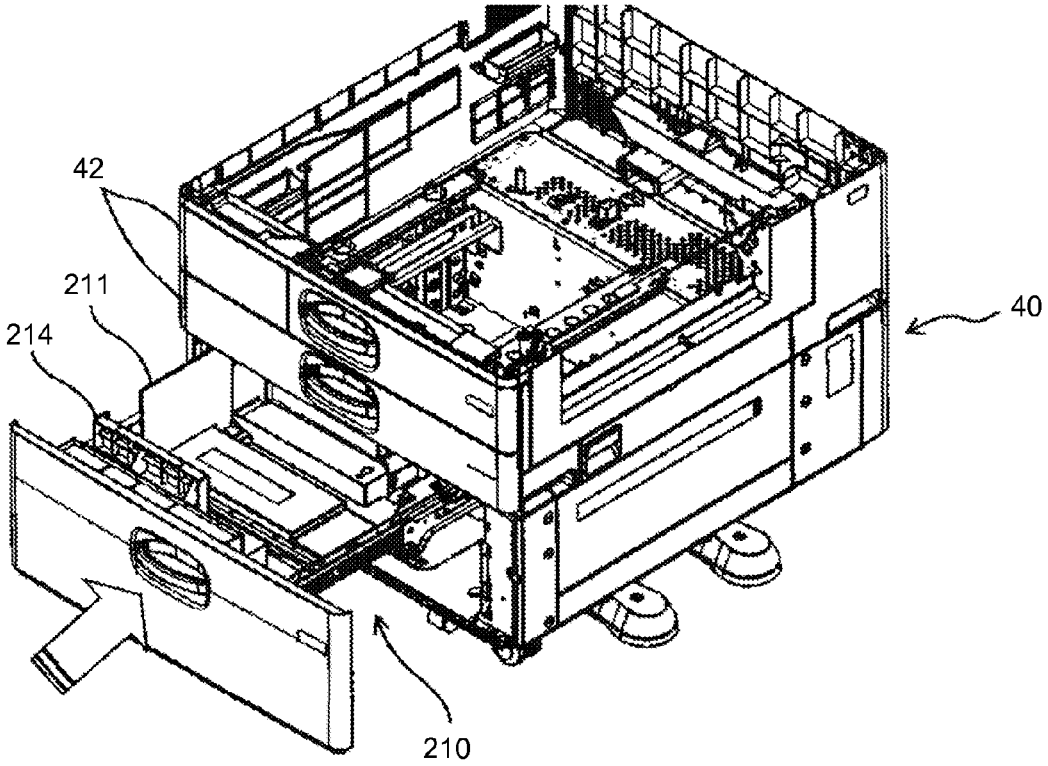
Figure 22:
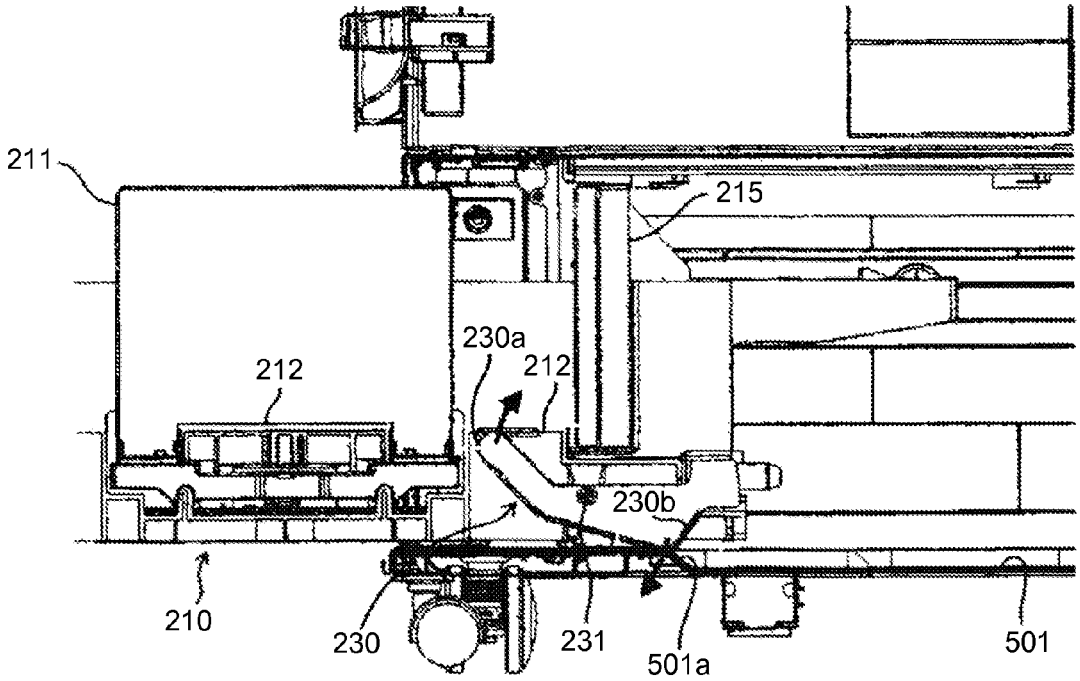
FIG. 22 is a cross section partially illustrating the stock bundle housing unit in the same state.

The above has described the behavior of the swing member 230 when the sheet bundle housing unit 210 in which the sheet bundle is set is pressed (inserted) into the apparatus body. Here, if the sheet bundle housing unit 210 is pressed into the apparatus body without setting the sheet bundle, as illustrated in FIG. 21, the swing member 230 behaves as follows. In the state where the stock bundle housing unit 210 is pulled out completely from the apparatus body, the swing member 230 has the posture stopped at the non-projection position in a swing direction, as described above. Thus, the sheet contact portion 230*a* of the swing member 230 is positioned under the sheet placement surface (the sheet contact portion 230*a* does not project above the sheet placement surface). In this state, the stock bundle housing unit 210 starts to be pressed in, as illustrated in FIG. 21. Then, the stock bundle housing unit 210 is moved to the position at which the base butting portion 230*b* of the swing member 230 starts to contact with the taper 501*a* of the base plate 501, as illustrated in FIG. 22. Until that time, the swing member keeps the same posture as when the pressing is started. Thereafter, when the sheet bundle housing unit 210 is further pressed in, the base butting portion 230*b* of the swing member 230 starts to move downward along the surface of the taper 501. With this, the swing member 230 starts to rotate in the clockwise direction in FIG. 22 about the swing axis member 231. Then, with this rotation, the height position of the sheet contact portion 230*a* of the swing member 230 gradually becomes higher. No sheet bundle is placed on the sheet placement surface that is a surface of the bottom plate 212, and thus the sheet contact portion 230*a* continues to move upward without butting against the sheet bundle. With this configuration, the swing member 230 continues to rotate without being prevented from rotating in the clockwise direction in FIG. 22.

Figure 23:
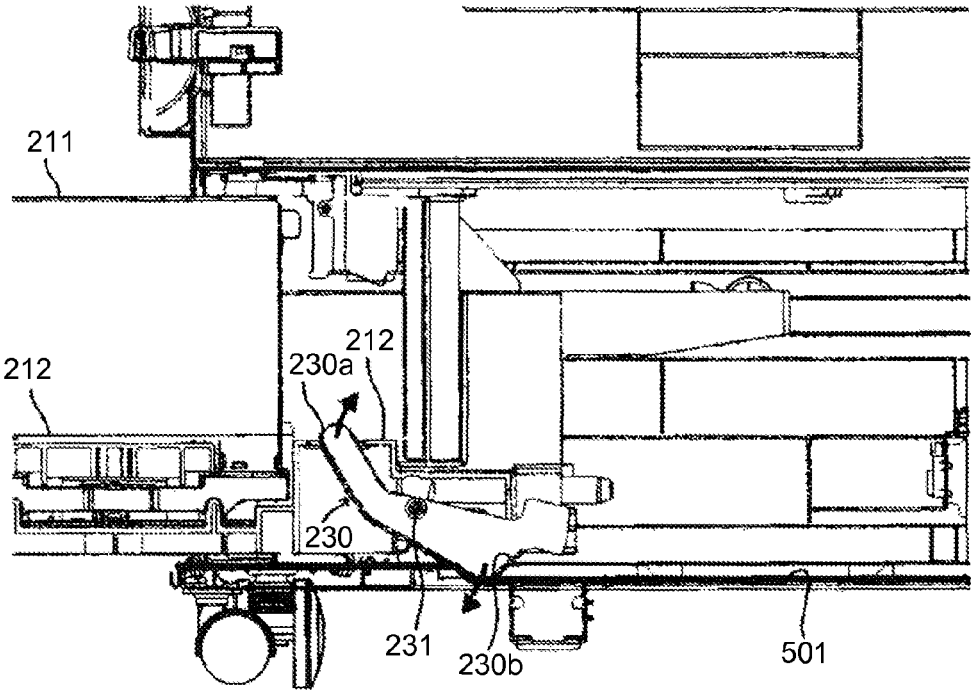
FIG. 23 is a cross section partially illustrating the stock bundle housing unit pressed in further as compared with FIG. 22.
Figure 24:
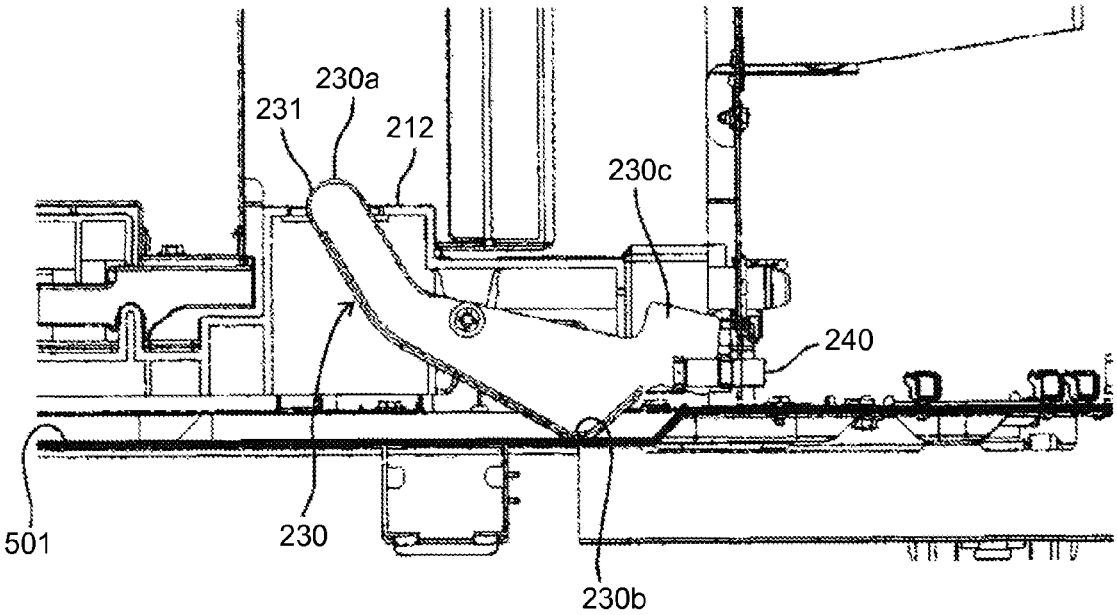
FIG. 24 is a cross section partially illustrating the stock bundle housing unit pressed in completely.

The rotation continues until the base butting portion 230*b* moves downward until the end of the taper 501*a*. Then, when the stock bundle housing unit 210 is pressed in until the base butting portion 230*b* is moved to the back side relative to the taper 501*a*, the sheet contact portion 230*a* of the swing member 230 significantly projects above the sheet placement surface, as illustrated in FIG. 23. In this state, when the stock bundle housing unit 210 is completely pressed (inserted) into the apparatus body, the portion 230*c* to be detected of the swing member 230 moves to the position of the optical sensor 240 in the front-back direction of the apparatus body, as illustrated in FIG. 24. Here, the portion 230*c* to be detected is positioned at the same height position as the optical sensor 240, that is, it is positioned right in front of the optical sensor 240. Thus, the portion 230*c* to be detected is detected by the optical sensor 240.

In the above configuration, the swing member 230, the optical sensor 240, the control unit described later, and other components constitute a sheet detection unit that detects presence or absence of a sheet bundle in the stock bundle housing unit 210. The base plate 501, the swing member 230, and other components constitute an interlocking mechanism. The interlocking mechanism achieves the following interlocking. That is, the swing member 230 is moved, along a swing direction, to the non-projection position by interlocking with the stock bundle housing unit 210 being pulled out from the apparatus body to the outside, regardless of presence or absence of the sheet bundle in the stock bundle housing unit 210. In addition, the swing member 230 not in contact with the sheet bundle in the stock bundle housing unit 210 is moved, along a swing direction, to the projection position by interlocking with the stock bundle housing unit 210 being pressed (inserted) into the apparatus body from the outside.

Figure 25:
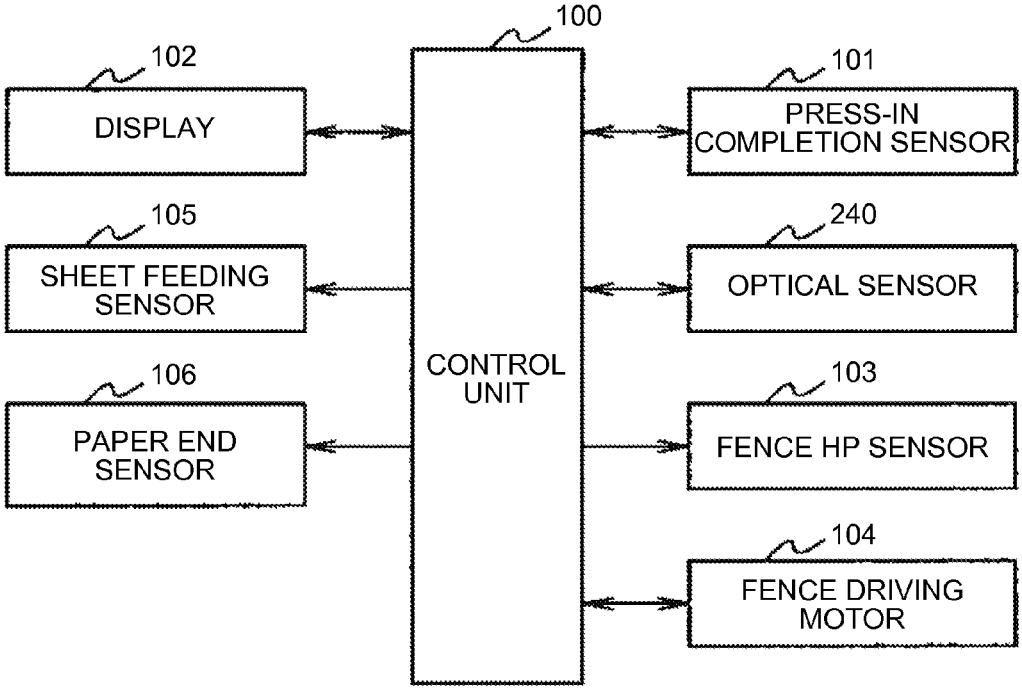
FIG. 25 is a block diagram illustrating a part of an electrical circuit of the copying machine.

FIG. 25 is a block diagram illustrating a part of an electrical circuit of the copying machine. In FIG. 25, a control unit 100 includes a central processing unit (CPU), a read-only memory (ROM) storing control programs, a random access memory (RAM) temporarily storing data, a nonvolatile flash memory, and other components. The control unit 100 performs various kinds of arithmetic processing, drives various driving system devices, and communicates with various sensors. The optical sensor 240, a press-in completion sensor 101, a display 102, a fence home position (HP) sensor 103, a fence driving motor 104, a sheet feeding sensor 105, a paper end sensor 106, and other components are electrically connected to the control unit 100.

The optical sensor 240 constitutes the sheet bundle detection unit together with the swing member 230 and other components, as described above. The press-in completion sensor 101 outputs press-in completion signals to the control unit 100 based on the detection, by a known technique, of the fact that the stock bundle housing unit 210 is completely pressed in the apparatus body. The display 102 includes a known liquid crystal display, and displays an image on a screen based on signals transmitted from the control unit 100. The fence HP sensor 103 outputs fence HP signals to the control unit 100 based on the detection of the fact that the transfer fence (211 in FIG. 12) of the stock bundle housing unit 210 is at the home position (position of 211 in FIG. 12) described above. The fence driving motor 104 is a motor that functions as a driving source for moving the transfer fence in the left-right direction of the apparatus body. The sheet feeding sensor 105 outputs sheet feeding confirmation signals to the control unit 100 based on the detection, by a known optical technique, of a recording sheet immediately after being fed to the sheet feeding path (44 in FIG. 1) from the sheet feeding unit (280 in FIG. 1) of the large-capacity sheet feeding unit. The paper end sensor 106 outputs paper end signals to the control unit 100 when it detects that no recording sheet is available in the sheet feeding unit (280 in FIG. 1).

The control unit 100 confirms presence or absence of a sheet bundle in the stock bundle housing unit 210 based on output voltage from the optical sensor 240 in the state where the press-in completion sensor 101 transmits press-in completion signals. To be more specific, in such a state, when the output voltage from the optical sensor 240 exceeds a given threshold, that is, when the portion 230*c* to be detected of the swing member 230 is detected by the optical sensor 240, the control unit 100 determines "absence of sheet bundle". By contrast, when the output voltage from the optical sensor 240 is equal to or smaller than a given threshold, that is, when the portion 230*c* to be detected is not detected by the optical sensor 240, the control unit 100 determines "presence of sheet bundle".

Moreover, when the control unit 100 receives paper end signals output from the paper end sensor 106, it determines presence or absence of a sheet in the stock bundle housing unit 210. As a result, when "presence of sheet bundle" is determined, the control unit 100 performs transfer processing for transferring a sheet bundle in the stock bundle housing unit 210 to the sheet feeding unit.

Figure 26:
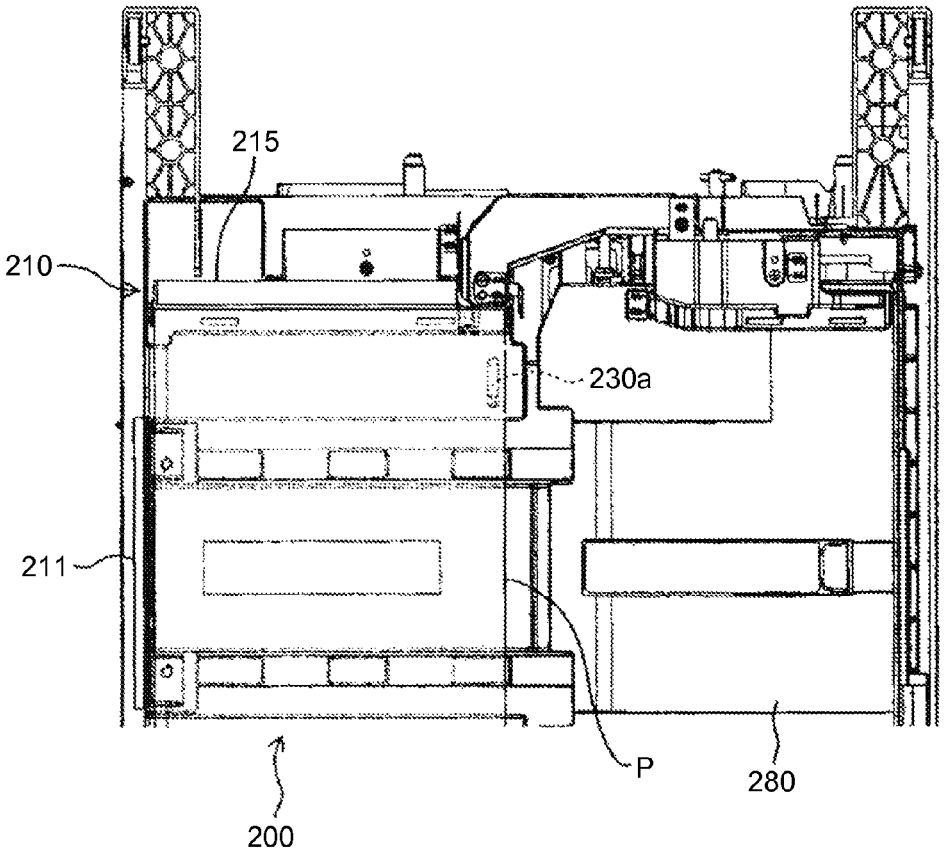
FIG. 26 is a plan view illustrating a large-capacity sheet feeding unit of the copying machine, when viewed from the upper side.

FIG. 26 is a plan view illustrating the large-capacity sheet feeding unit 200, when viewed from the upper side. The arrow in FIG. 26 represents the transfer direction of the sheet bundle from the stock bundle housing unit 210 to the sheet feeder 280. The sheet contact portion 230*a* of the swing member 230 of the stock bundle housing unit 210 is disposed in a sheet bundle placement area in the face direction of the sheet placement surface. Thus, the sheet contact portion 230*a* under the sheet placement surface is positioned directly under the sheet bundle placed on the sheet placement surface. When the stock bundle housing unit 210 is completely pressed in the apparatus body, the sheet contact portion 230*a* is in contact with the sheet bundle on the sheet placement surface. However, the sheet contact portion 230*a* is at the same height position as the sheet placement surface, and thus the sheet contact portion 230*a* does not impose a large load on the sheet bundle being transferred.

In FIG. 26, the arrow direction is the transfer direction of the sheet bundle, as described above. A swing axis line of the swing axis member (231) (not illustrated) is along the transfer direction. That is, the swing member (230) is disposed in the posture in which the swing axis line is along the transfer direction. Moreover, the thickness direction of the flat swing member (230) is along the swing axis line direction and the transfer direction.

When the transfer processing is started, the control unit 100 first drives the fence driving motor 104 to rotate normally, and slides the transfer fence (211) of the stock bundle housing unit 210 from the home position to the right side of the apparatus body, as illustrated with the arrow in FIG. 26. With this configuration, the sheet bundle is gradually pressed toward the sheet feeder 280 from the stock bundle housing unit 210.

Figure 27:
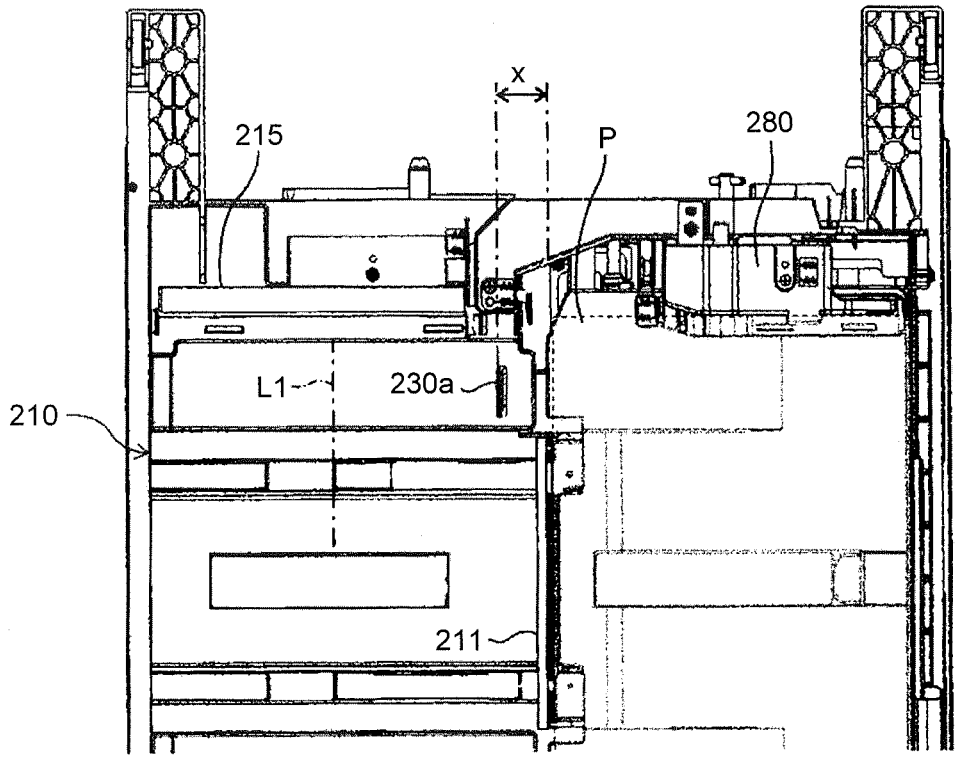
FIG. 27 is a plan view illustrating the large-capacity sheet feeding unit immediately after the transfer of the sheet bundle is completed, when viewed from the upper side.
Figure 28:
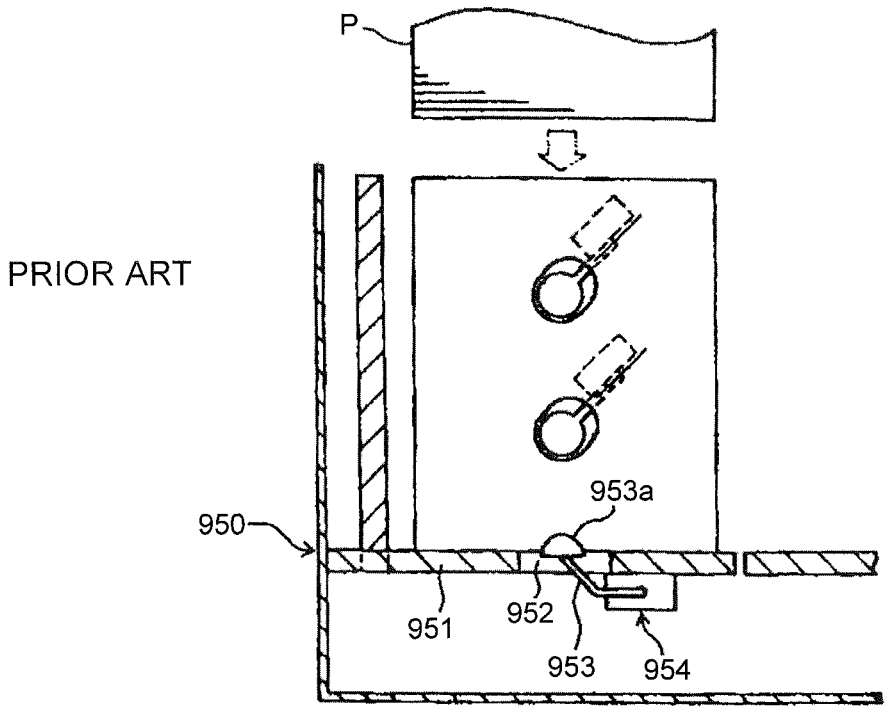
FIG. 28 is a cross section partially illustrating a sheet feeding tray of an image forming apparatus described in Japanese Patent No. 4057232.

FIG. 27 is a plan view illustrating the large-capacity sheet feeding unit 200 immediately after the transfer of the sheet bundle from the stock bundle housing unit 210 to the sheet feeder 280 is completed. When the sheet bundle is transferred to the sheet feeder 280, no sheet bundle is left on the sheet placement surface of the stock bundle housing unit 210. Thus, the sheet contact portion 230*a* of the swing member projects above the sheet placement surface. Thus, the optical sensor (240) detects "presence of sheet bundle" in the state of FIG. 26 immediately after the transfer of the sheet bundle is started, by contrast, the optical sensor (240) detects "absence of sheet bundle" in the state of FIG. 27 immediately after the transfer of the sheet bundle is completed. The timing at which "presence of sheet bundle" is switched to "absence of sheet bundle" (hereinafter, referred to as "detection switching timing") is timing at which the left end of the sheet bundle passes the sheet contact portion 230*a* and the sheet contact portion 230*a* projects above the sheet placement surface. Here, the state of the sheet contact portion 230*a* is switched at once from the non-projecting state to the projecting state. This is because the state in which the sheet contact portion 230*a* butts against the sheet bundle at a height position of the sheet placement surface is instantaneously switched to the state in which the sheet bundle is not left directly on the sheet contact portion 230*a* and the restraint of the sheet contact portion 230*a* is released.

It is assumed that the swing member is disposed not in the posture in which the thickness direction of the sheet contact portion 230*a* (and the swing member 230) is along the transfer direction, as illustrated in FIG. 27, but in the posture in which the longitudinal direction of the swing member (230) is along the transfer direction. When the left end of the sheet bundle being transferred passes directly on the sheet contact portion 230*a*, the curved surface of the sheet contact portion 230*a* curving with a given curvature gradually projects above the sheet placement surface with the transfer of the sheet bundle. Thus, the portion (230*c*) to be detected of the swing member does not retract instantaneously from the position facing the optical sensor (240) but retract gradually, and the output voltage from the optical sensor (240) increases gradually. In this configuration, there occurs an error between the timing at which the left end of the sheet bundle being transferred passes directly on the sheet contact portion 230*a* (hereinafter, referred to as "passing completion timing") and the timing at which the output voltage exceeds a threshold (="detection switching timing"). This error makes it impossible to detect "passing completion timing" accurately. Consequently, the transfer completion timing cannot be grasped accurately based on elapsed time from the "passing completion timing".

By contrast, in the copying machine, when the left end of the sheet bundle being transferred passes directly on the sheet contact portion 230*a*, the state where the sheet contact portion 230*a* does not project above the sheet placement surface is switched at once to the state where it projects above the sheet placement surface. Thus, the output voltage of the optical sensor increases at once and exceeds the threshold, and an error hardly exists between "passing completion timing" and "detection switching timing". Therefore, it is possible to grasp transfer completion timing based on elapsed time from the "detection switching timing".

However, when the sheet contact portion 230*a* is disposed at a position relatively apart from the sheet feeder 280 in the transfer direction, the elapsed time from "detection switching timing" to transfer completion timing becomes relatively long. Even when the fence driving motor 104 is rotated accurately at a designed rotation speed, an engagement error of gears causes a certain error in the movement speed of the transfer fence 211. Thus, when the above-described elapsed time is relatively long, an error between actual transfer completion timing and transfer completion timing grasped based on the elapsed time from "detection switching timing" becomes large. For this reason, in the copying machine, the swing member (230) is disposed so that the sheet contact portion 230*a* is positioned near the sheet feeder 280 in the transfer direction. This configuration significantly shortens a movement distance (x in FIG. 27) of the sheet bundle from passing of the left end of the sheet bundle directly on the sheet contact portion 230*a* until completion of the transfer of the sheet bundle. That is, the above-described elapsed time becomes significantly short. Therefore, it is possible to accurately grasp transfer completion timing without providing a special sensor and accurately transfer the sheet bundle to a given position of the sheet feeder 280. In order to reduce the above-described error, it is preferable to arrange the swing member (230) on the side of the sheet feeder 280 relative to the center of the transfer direction (L1 in FIG. 27) in the entire area in the transfer direction of the sheet placement surface.

In the transfer processing, the control unit 100 having driven the fence driving motor 104 to rotate normally waits the arrival of "detection switching timing" while monitoring the output voltage from the optical sensor 240. When "detection switching timing" has arrived, the control unit 100 starts clocking processing, and stops the normal rotation drive of the fence driving motor 104 once the clocked value becomes a given value. Note that when the optical sensor 240 detects "presence of sheet bundle" even if a given upper limit of time has passed since the start of the normal rotation drive of the fence driving motor 104 (when "detection switching timing" does not arrive), it is considered that some problems have occurred. In such a case, the control unit 100 stops the fence driving motor 104 forcedly and displays an alarm on the display 102.

The control unit 100 accurately transfers the sheet bundle to a normal transfer position in the sheet feeder 280, and then starts reverse drive of the fence driving motor 104 to move the transfer fence 211 to the home position. When fence HP signals are received from the fence HP sensor 103, the control unit 100 stops the reverse drive of the fence driving motor 104. In this manner, the transfer fence 211 accurately stops at the home position.

The above has described one example, and the invention exerts unique effects according to each of the following forms.

Aspect A

An image forming apparatus, including a sheet bundle housing unit (stock bundle housing unit 210, for example) that houses a plurality of recording sheets piled as a sheet bundle, a sheet detection unit (swing member 230, optical sensor 240, etc., for example) that detects presence or absence of the sheet bundle in the sheet bundle housing unit using a swing member (swing member 230, for example) configured to swing about a swing axis (swing axis member 231, for example) the swing member including a sheet contact portion (sheet contact portion 230*a*, for example) provided on one end side thereof relative to the swing axis and, in a state where swing of the swing member is stopped at a projection position at which the sheet contact portion projects above a sheet placement surface (surface of the bottom plate 212, for example) of the sheet bundle housing unit, the swing member moves to a non-projection position at which the sheet contact portion does not project above the sheet placement surface along the swing direction as the sheet bundle placed on the sheet placement surface presses the sheet contact portion, a visible image forming unit (image forming unit 1, for example) that forms a visible image on the recording sheet, and an interlocking mechanism (swing member 230, base plate 501, etc., for example) that moves the swing member to the non-projection position, regardless of presence or absence of the sheet bundle in the sheet bundle housing unit, by interlocking with the sheet bundle housing unit being pulled out from inside of an apparatus body to outside of the apparatus body, and moves the swing member not in contact with the sheet bundle in the sheet bundle housing unit to the projection position by interlocking with the sheet bundle housing unit being pressed into the inside of the apparatus body from the outside of the apparatus body. In such a configuration, when an operator pulls out the sheet bundle housing unit from the image forming apparatus body to refill the sheet bundle housing unit with the sheet bundle, the interlocking mechanism moves, with such pulling, the swing member to the non-projection position so that the sheet contact portion of the swing member retracts from the sheet placement surface. With this configuration, even when the operator places the sheet bundle in any position on the sheet placement surface, the sheet bundle is not in contact with the sheet contact portion. Thus, it is possible to refill the sheet bundle housing unit with a sheet bundle without allowing the sheet bundle to be caught on the sheet contact portion or damaged by rubbing with the sheet contact portion. If no sheet bundle exists in the sheet bundle housing unit when the operator presses the sheet bundle housing unit into the image forming apparatus body, the interlocking mechanism moves the swing member to the projection position. This movement enables the sheet detection unit to normally detect "absence" of a sheet bundle. When a sheet bundle exists in the sheet bundle housing unit, the movement of the swing member to the projection position, which is caused by the interlocking mechanism, is prevented by the sheet bundle, and the sheet bundle continues to be restrained at the non-projection position. Thus, the sheet detection unit normally detects "presence" of a sheet bundle. Therefore, even if the swing member is moved to the non-projection position by the interlocking mechanism when the sheet bundle housing unit is pulled from the image forming apparatus body, it is possible to allow the sheet detection unit to normally detect presence or absence of a sheet bundle when the sheet bundle housing unit is pressed into the image forming apparatus.

Aspect B

Aspect B is characterized in that, in Aspect A, the swing member is provided, on the other end side thereof opposite to the one end side, with a portion to be detected (portion 230*c* to be detected, for example) that is detected by a sensor depending on a swing position of the swing member, and the sheet detection unit is provided with the sensor (optical sensor 240, for example) that detects the portion to be detected depending on the swing position. In such a configuration, it is possible to detect presence or absence of a sheet bundle with the use of a general-purpose reasonable sensor available in the market such as an optical sensor or a proximity sensor that can detect a portion to be detected.

Aspect C

Aspect C is characterized in that, in Aspect A or B, the interlocking mechanism is provided with a butted portion (base plate 501, for example) against which the other end side of the swing member held by the sheet bundle housing unit pressed in the apparatus body butts, and with movement of the swing member about the swing axis when the sheet bundle is not in contact with the sheet contact portion, the other end side inclining to move downward in the gravity direction butts against the butted portion so as to stop the swing member held by the sheet bundle housing unit pressed in the apparatus body at the projection position. In such a configuration, it is possible to detect presence or absence of a sheet bundle by the simple configuration in which the other end side of the swing member butts against the butted portion so as to control the swing stop position of the swing member.

Aspect D

Aspect D is characterized in that, in Aspect C, the interlocking mechanism includes a first butted portion (back side relative to the taper 501*a* of the base plate 501, for example) as the butted portion, and a second butted portion (front side relative to the taper 501*a* of the base plate 501, for example) against which the other end side of the swing member held by the sheet bundle housing unit pulled out to the outside of the apparatus body butts, and with movement of the swing member about the swing axis when the sheet bundle is not in contact with the sheet contact portion, the other end side inclining to move downward in the gravity direction butts against the second butted portion, thereby stopping the swing member held by the sheet bundle housing unit pulled out to the outside of the apparatus body at the non-projection position. In such a configuration, it is possible to detect presence or absence of a sheet bundle by the simple configuration in which the posture of the swing member is changed using the difference of an arrangement position between the first butted portion and the second butted portion.

Aspect E

Aspect E is characterized in that, in Aspect D, the swing axis is arranged at a position on the one end side relative to the center of gravity (point of center of gravity Pa, for example) of the swing member. In such a configuration, the rotation force about the swing axis is applied to the swing member using the weight of the swing member, which can change the posture of the swing member without providing any special biasing unit such as a spring or an actuator.

Aspect

Aspect F is characterized in that, in Aspects A to E, the image forming apparatus includes a first sheet bundle housing unit (stock bundle housing unit 210, for example) as the sheet bundle housing unit, a second sheet bundle housing unit (sheet feeder 280, for example) adjacent to the first sheet bundle housing unit, and a transfer unit that slides and transfers the sheet bundle in the first sheet bundle housing unit into the second sheet bundle housing unit. In such a configuration, when no sheet is available in the second sheet bundle housing unit, it is possible to refill the second sheet bundle housing unit with the sheet bundle stocked in the first sheet bundle housing unit.

Aspect G

Aspect G is characterized in that, in Aspect F, the swing member is formed to be flat and disposed in a posture in which the thickness direction thereof is along the line direction of the swing axis and the line direction of the swing axis is along the transfer direction of the sheet bundle by the transfer unit (transfer fence 211, fence driving motor 104, for example), and the image forming apparatus is provided with a timing determining unit (control unit 100, for example) that determines finish timing of transfer by the transfer unit based on timing at which a detection result by the sheet detection unit is changed from presence of sheet to absence of sheet during transfer of the sheet bundle by the transfer unit. In such a configuration, as described in the embodiment, it is possible to stop transfer of the sheet bundle at timing when the sheet bundle is transferred to a normal transfer position without providing a special sensor such as a sensor detecting a sheet bundle transferred to the normal transfer position.

Aspect H

Aspect H is characterized in that, in Aspect G, the swing member is held at a position on a downstream side relative to a center (center line L1, for example) in the transfer direction in the first sheet bundle housing unit. In such a configuration, as described in the embodiment, it is possible to grasp timing at which the sheet bundle is transferred to the normal transfer position more accurately as compared with a case in which the swing member is disposed on an upper stream side relative to the center.

Aspect I

Aspect I is characterized in that, in Aspect G or H, the image forming apparatus further includes a control unit (control unit 100, for example) that forcedly stops transfer caused by the transfer unit and outputs an abnormality alarm based on a fact that the detection result of presence of sheet continues for a given time of period or longer or for a period of time exceeding a given time after start of transfer of the sheet bundle from the first sheet bundle housing unit to the second sheet bundle housing unit. In such a configuration, it is possible to avoid occurrence of a failure due to transfer drive continued even when some problems disable transfer of the sheet bundle.

Aspect J

Aspect J is characterized in that, in Aspect D or E, in a process of pulling out the sheet bundle housing unit from the apparatus body, the other end side of the swing member moving together with the sheet bundle housing unit is separated from the first butted portion and butts against the second butted portion before the sheet bundle housing unit is moved to a position at which an entire area of the sheet placement surface is pulled out to the outside of the apparatus body. In such a configuration, it is possible to make sure that the sheet contact portion of the swing member projects above the sheet placement surface when the sheet bundle housing unit is completely pulled out from the apparatus body. In addition, it is possible to make sure that the sheet contact portion of the swing member does not project above the sheet placement surface when the sheet bundle housing unit is completely pressed in the apparatus body.

According to the embodiments, it is possible to refill the sheet bundle housing unit with a sheet bundle without allowing the sheet bundle to be caught on the sheet contact portion or damaged by rubbing with the sheet contact portion.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a sheet bundle housing unit that houses a plurality of recording sheets piled as a sheet bundle;

a swing member having a sheet contact portion on one end side thereof relative to a swing axis, the swing member swinging, about the swing axis, between a projection position at which the sheet contact portion projects above a sheet placement surface of the sheet bundle housing unit and a non-projection position at which the sheet contact portion does not project above the sheet placement surface, the swing member moving from the projection position to the non-projection position by pressing of the sheet bundle placed on the sheet placement surface against the sheet contact portion;

a sheet detection unit that detects presence or absence of the sheet bundle in the sheet bundle housing unit using the swing member;

a visible image forming unit that forms a visible image on the recording sheet; and an interlocking mechanism that moves the swing member to the non-projection position, regardless of presence or absence of the sheet bundle in the sheet bundle housing unit, by interlocking with the sheet bundle housing unit being pulled out from an apparatus body, wherein the interlocking mechanism includes a butted portion against which another end side of the swine member held by the sheet bundle housing unit inserted in the apparatus body butts, and with movement of the swing member about the swing axis when the sheet bundle is not in contact with the sheet contact portion, the another end side inclining to move downward in a gravity direction butts against the butted portion so as to stop the swing member held by the sheet bundle housing unit inserted in the apparatus body is stopped at the projection position.

2. The image forming apparatus according to claim 1, wherein the interlocking mechanism moves the swing member not in contact with the sheet bundle in the sheet bundle housing unit to the projection position by interlocking with the sheet bundle housing unit being inserted into the apparatus body.

3. The image forming apparatus according to claim 1, wherein, the swing member has a detected portion on the another end side thereof, and the sheet detection unit includes a sensor that detects the butted detected portion depending on a swing position of the swing member.

4. The image forming apparatus according to claim 1, wherein the interlocking mechanism includes a first butted portion as the butted portion, and a second butted portion against which the another end side of the swing member held by the sheet bundle housing unit pulled out from the apparatus body butts, and with movement of the swing member about the swing axis when the sheet bundle is not in contact with the sheet contact portion, the other end side inclining to move downward in the gravity direction butts against the second butted portion so as to stop the swing member held by the sheet bundle housing unit pulled out from the apparatus body at the non-projection position.

5. The image forming apparatus according to claim 4, wherein the swing axis is arranged at a position on the one end side relative to center of gravity of the swing member.

6. The image forming apparatus according to claim 4, wherein in a process of pulling out the sheet bundle housing unit from the apparatus body, the another end side of the swing member moving together with the sheet bundle housing unit is separated from the first butted portion and butts against the second butted portion before the sheet bundle housing unit is moved to a position at which an entire area of the sheet placement surface is pulled out from the apparatus body.

7. The image forming apparatus according to claim 1, further comprising:

a first sheet bundle housing unit as the sheet bundle housing unit;

a second sheet bundle housing unit adjacent to the first sheet bundle housing unit; and a transfer unit that slides and transfers the sheet bundle in the first sheet bundle housing unit into the second sheet bundle housing unit.

8. The image forming apparatus according to claim 7, wherein the swing member has a flat shape, the swing member is disposed in a posture in which a thickness direction thereof is along a line direction of the swing axis and the line direction of the swing axis is along a transfer direction of the sheet bundle by the transfer unit, and the image forming apparatus further comprises a timing determining unit that determines finish timing of transfer by the transfer unit based on timing at which a detection result by the sheet detection unit is changed from presence of sheet to absence of sheet during transfer of the sheet bundle by the transfer unit.

9. The image forming apparatus according to claim 8, wherein the swing member is held at a position on a downstream side relative to center in the transfer direction in the first sheet bundle housing unit.

10. The image forming apparatus according to claim 8, further comprising a control unit that forcedly stops transfer caused by the transfer unit and outputs an abnormality alarm based on a fact that the detection result of presence of sheet continues for a given time of period or longer or for a period of time exceeding a given time after start of transfer of the sheet bundle from the first sheet bundle housing unit to the second sheet bundle housing unit.

* * * * *